US006808335B2

(12) United States Patent
Stamm et al.

(10) Patent No.: US 6,808,335 B2
(45) Date of Patent: Oct. 26, 2004

(54) METHOD OF RECONSTRUCTING EXISTING BRIDGES AND HIGHWAYS WITH MINIMAL DISRUPTION OF TRAFFIC

(76) Inventors: Anna Stamm, 226 E. 10th St. #8, New York, NY (US) 10003; Eugenia Stamm, 2 Horizon Rd., Apt. 1408, Fort Lee, NJ (US) 07024; Rolan Stamm, 2 Horizon Rd., Apt. 1408, Fort Lee, NJ (US) 07024

( * ) Notice: Subject to any disclaimer, the term of this patent is extended or adjusted under 35 U.S.C. 154(b) by 0 days.

(21) Appl. No.: 10/356,954

(22) Filed: Feb. 3, 2003

(65) Prior Publication Data

US 2003/0123932 A1 Jul. 3, 2003

Related U.S. Application Data

(62) Division of application No. 10/000,267, filed on Nov. 28, 2001.

(60) Provisional application No. 60/250,187, filed on Nov. 30, 2000.

(51) Int. Cl.[7] ..... E01C 1/00

(52) U.S. Cl. ..... 404/72; 404/14; 404/78

(58) Field of Search ..... 404/1, 72, 75, 404/17; 14/77.1, 78, 2.4, 18

(56) References Cited

U.S. PATENT DOCUMENTS

| | | | | | |
|---|---|---|---|---|---|
| 1,924,779 A | | 8/1933 | Flynn | 37/108 |
| 3,654,652 A | * | 4/1972 | Pleasants | 14/18 |
| 3,811,147 A | | 5/1974 | Dix | 14/1 |
| 4,272,210 A | * | 6/1981 | Shoji et al. | 404/1 |
| 4,592,673 A | * | 6/1986 | Lee | 404/1 |
| 4,698,866 A | | 10/1987 | Kano | 14/1 |
| 4,953,249 A | * | 9/1990 | Warwick | 14/2.4 |
| 5,042,957 A | | 8/1991 | Arita et al. | 404/71 |
| 5,105,494 A | | 4/1992 | Ogg | 14/78 |

FOREIGN PATENT DOCUMENTS

| | | | |
|---|---|---|---|
| DE | 2653515 | 6/1978 | E01C/23/06 |
| DE | 3107408 | 11/1982 | E01D/15/12 |
| GB | 2227268 | 7/1990 | E01D/1/00 |

* cited by examiner

*Primary Examiner*—Robert E. Pezzuto
*Assistant Examiner*—Alexandra Pechhold

(57) ABSTRACT

A method of reconstructing existing roadway (21) on order to restore structural integrity of bridge roadway (23) with minimal disruption of traffic. First elevated roadway (41), which comprises a plurality of interconnected ramp units and bridging units, is erected in multiple steps by initially erecting an initial portion of roadway (41) from entrance/exit ramp units (45) and (46) with their uppermost ends facing each other. Then repeatedly, during periods of off-peak traffic, until roadway (41) is erected, performing a step of creating a gap in a previously erected portion of roadway (41) by moving ramp unit (45) along roadway (21), erecting a bridging unit in the gap, and opening an extended portion of roadway (41) to traffic prior to the next period of peak traffic. Structural integrity of roadway (23) is then restored by repeatedly closing a number of existing travel lanes to traffic, while rerouting traffic onto the newly erected roadway (41), and restoring the closed travel lanes without interruption. This method can be used for reconstructing different types of bridges and highways.

11 Claims, 20 Drawing Sheets

METHOD OF RECONSTRUCTING EXISTING BRIDGES AND HIGHWAYS WITH MINIMAL DISRUPTION OF TRAFFIC

CROSS-REFERENCE TO RELATED APPLICATIONS

This application is entitled to the benefit of provisional Patent Application Ser. No. 60/250,187 filed Nov. 30, 2000.

This is a division of Ser. No. 10/000,267, filed on Nov. 28, 2001.

FEDERALLY SPONSORED RESEARCH

Not Applicable

SEQUENCE LISTING OR PROGRAM

Not Applicable

BACKGROUND

1. Field of Invention

This invention relates to the field of reconstructing existing bridges and highways, specifically to methods of restoring structural integrity of existing roadways.

2. Prior Art

There are more and more vehicles that use existing transportation infrastructure every year. Due to a drastic increase in traffic load and volume, this aging infrastructure is rapidly deteriorating. At the same time, especially in urban areas, construction of new transportation facilities is severely restricted by environmental regulations, high costs, and existing land development. Therefore, reconstructing existing bridges and highways in order to restore their structural integrity very often remains the only choice available.

Several prior art methods of reconstructing existing roadways in order to restore their structural integrity are well known. One of the methods involves closing an existing roadway to traffic while detouring traffic onto alternative roadways. However, detours are not always possible and, when they are, traffic would spill over onto adjacent roadways, creating traffic jams and safety hazards resulting in increased air pollution, costly disruption of local businesses, and interference with local traffic.

Other methods utilize slowly advancing moveable elevated roadways that provide a travel path for existing traffic, while existing roadway restoration work is performed underneath. They are described in U.S. Pat. Nos. 1,924,779 to B. H. Flynn (1933), 3,811,147 to R. C. Dix (1974), 4,698,866 to H. Kano (1987), 5,042,957 to M. Arita et al (1991), 5,105,494 to D. C. Ogg (1992), German Patents DE2653515 to G. Albersinger (1978), DE3107408 to H. R. Baser (1982), and British Patent GB2227268 to H. R. Fish (1990). Some of these moveable roadways provide an overpass with a single travel lane. They are designed for easier transport from site to site, however, in order to restore an entire width of an existing roadway, these moveable roadways have to make several passes over the same portion of the existing roadway. Other moveable roadways cover an entire width of an existing roadway, which can be restored in a single pass. But, due to their size, they are expensive to transport from site to site and require significant assembly and disassembly, which disrupt existing traffic. Also, due to significant additional weight that these devices impose on an underlying existing structure, their use on bridges is extremely limited.

Another method involves closing at least one of the existing roadway travel lanes to traffic for duration of its restoration, while traffic is rerouted onto those travel lanes that remain open. When restoration of the closed lane is completed, and the lane is reopened to traffic, the same procedure is then repeated for other existing travel lanes, resulting in restoration of the entire roadway. This method, however, is infrequently used because the existing travel lanes that remain open to traffic need to accommodate traffic from the closed lane. This can only take place on an existing roadway that has an overabundance of traffic capacity, which is a rare occurrence, especially in urban areas.

Therefore, if none of the previously described prior art methods can be utilized, which is currently the case on most existing bridges and highways, then a travel lane is closed to traffic for a relatively short duration of time, usually during night hours, and construction equipment, materials and personnel are moved to a roadway restoration area prior to start of restoration work. A relatively small area of the closed lane is then restored overnight, in sub-standard conditions and in a rushed manner. Construction equipment, materials and personnel are then removed from the restoration area prior to re-opening the previously closed travel lane in time for the next period of peak traffic, usually by early morning. As a result, the restoration work sometimes takes years to complete, quality of workmanship suffers, cost of restoration becomes excessive, and useful life of the roadway is shortened.

The previous discussion demonstrates that disruption of existing traffic due to inadequate traffic capacity of existing bridges and highways is the major reason why restoring structural integrity of existing roadways continuously remains one of the most frequently encountered problems in the field.

Transportation authorities, such as Federal, State, and Municipal Departments of Transportation, and public and private transportation agencies, that govern existing bridges and highways, recognize the problem of traffic disruption that occurs during restoration of existing roadways. And since traffic volumes on existing roadways vary significantly between peak and off-peak traffic, the authorities issue regulations that specify when and how many of existing travel lanes shall be open to traffic, and when and how many of them may be closed with minimal disruption of existing traffic. Generally, all travel lanes of existing roadways are required to be open during periods of peak traffic, from early morning to late afternoon, but a predetermined number of travel lanes are allowed to be closed during periods of off-peak traffic, mostly during night hours, with minimal disruption of existing traffic.

The aforementioned regulations provide a window of opportunity for developing methods of reconstructing existing roadways in order to restore their structural integrity with minimal disruption of traffic. Conceptually such a method would involve first increasing traffic capacity of an existing roadway by erecting a new elevated roadway above an existing roadway with minimal disruption of traffic, then rerouting existing traffic from the existing roadway onto the new elevated roadway, and then restoring structural integrity of the existing roadway with minimal disruption of existing traffic.

Prior art has not yet successfully developed such methods, and as a result, many existing bridges and highways, especially in urban areas, suffer from structural deficiencies for many years.

SUMMARY

A novel method of reconstructing existing roadways in order to restore their structural integrity with minimal disruption of traffic is provided. In accordance with this method roadway reconstructing is performed in two consecutive stages. During the first stage (Stage A), a new elevated roadway, which comprises a predetermined number of interconnected ramp units and bridging units, is erected above an existing roadway with minimal disruption of existing traffic. This new elevated roadway increases traffic capacity of the existing roadway by providing elevated travel lanes. During the second stage (Stage B), existing traffic is rerouted from the existing roadway onto the new elevated roadway, thus enabling restoration of structural integrity of the existing roadway to be performed with minimal disruption of existing traffic. This method is easily adapted for use on different types of bridges and highways.

OBJECTS AND ADVANTAGES

Structural deterioration of existing roadways is one of the most frequently encountered problems in the field of reconstructing existing bridges and highways. The primary object of the present invention is to provide a novel, simple and economical solution that enables restoring structural integrity of existing roadways with minimal disruption of existing traffic. This object is accomplished by developing methods and utilizing devices that, working synergistically, offer a complete realization of the task.

Accordingly, a highly efficient method of reconstructing existing roadways in order to restore their structural integrity with minimal disruption of existing traffic is provided. This novel method of reconstructing comprises:

Stage A—erecting a new elevated roadway above an existing roadway with minimal disruption of existing traffic as described below, and Stage B—rerouting existing traffic from the existing roadway onto the new elevated roadway, and then restoring structural integrity of the existing roadway with minimal disruption of existing traffic.

During Stage A of reconstructing, in accordance with the preferred embodiment of this method, a new elevated roadway, comprising a predetermined number of interconnected ramp units and bridging units, is erected in multiple steps, mostly during periods of off-peak traffic, and, after completion of each step, it is opened to existing traffic in time for the next period of peak traffic.

The initial step of erecting the new elevated roadway involves erecting at least two entrance/exit ramp units, at least one of which is made moveable. The ramp units are positioned so that an uppermost end of one ramp unit faces an uppermost end of another ramp unit and, when erection of the ramp units is completed, they embody an initial portion of the new elevated roadway that may be opened to traffic, if specified by a transportation authority.

The next step, which is executed during a period of off-peak traffic as specified by the transportation authority, involves closing the previously erected portion of the elevated roadway to existing traffic and creating a gap in the previously erected portion of the elevated roadway by moving the moveable ramp unit along the existing roadway. A bridging unit is then erected in the gap and the moveable ramp is moved back, if necessary, to adjoin the bridging unit. Consequently, an extended portion of the elevated roadway is erected, and it is opened to existing traffic in time for the next period of peak traffic as specified by the transportation authority.

The step of closing a previously erected portion of the elevated roadway to existing traffic during a period of off-peak traffic as specified by the transportation authority, creating a gap in the previously erected portion of the elevated roadway by moving the moveable ramp unit along the existing roadway, erecting a bridging unit in the gap, and opening an extended portion of the elevated roadway to existing traffic in time for the next period of peak traffic as specified by the transportation authority is repeated many times until erection of the predetermined number of the bridging units is completed.

Thus, Stage A of reconstructing is performed with minimal disruption of existing traffic, because, at each step, the previously erected portion of the elevated roadway is open to existing traffic during periods of peak traffic, and it is closed to existing traffic during periods of off-peak traffic.

During Stage B of reconstructing, following completion of erecting the new elevated roadway, structural integrity of the existing roadway is restored in a small number of steps with minimal disruption of existing traffic. Each step involves closing a predetermined number of existing travel lanes to existing traffic, rerouting existing traffic from the closed travel lanes onto the new elevated roadway, restoring structural integrity of the existing travel lanes closed to traffic and rerouting existing traffic back onto the existing travel lanes that have been restored. The step is repeated, if necessary, until the entire roadway restoration is completed with minimal disruption of existing traffic.

Accordingly, both stages of reconstructing the existing roadway are performed with minimal disruption of existing traffic.

Another major object of this invention is to shorten duration of reconstructing existing roadways. During Stage A of reconstructing this object is achieved by utilizing space underneath previously erected portion of elevated roadway to store construction and safety equipment and materials, and to house construction field offices and staging areas, thereby saving time usually required to move these items and personnel to and from work areas.

This object is also achieved by utilizing the space underneath a moveable ramp unit for performing erecting work during periods of peak traffic. This work may include, for example, preparing an existing roadway for coming erection of bridging units or surveying condition of existing load-carrying structural members of the existing roadway. This work is time-consuming and complex, especially when performed at night, however, when the space underneath the moveable ramp unit is utilized, the work is conducted during day-time, while existing peak traffic flows overhead. As a result the quality of workmanship is improved and erecting work is continuously conducted during periods of peak traffic and periods of off-peak traffic, thereby shortening overall duration of construction.

During Stage B of reconstructing this object is achieved by closing existing travel lanes to existing traffic for the duration of their restoration so that the restoration work is performed continuously during periods of peak traffic and periods of off-peak traffic.

This object is further achieved by minimizing a number of different temporary traffic patterns during restoration, and by keeping the established traffic patterns during periods of peak traffic and periods of off-peak traffic.

Still another object of this invention is to make it versatile enough to be used on different types of existing bridges and highways. This object is achieved by minimizing dead load applied to these existing structures by utilizing various light-weight structural forms and materials for new elevated roadways and for restoration work.

Bridging units and ramp units are composed of individual structural members such as deck panels, stringers, braces, and of main frames consisting of columns and floor-beams.

The main frames, usually of T, double-T (TT), or portal types, are generally oriented transversely to the direction of traffic, and they serve to support other structural members. The main frames and other structural members may be made of steel, aluminum, other light-weight alloys, or fiber reinforced composite materials in order to minimize their weight, which is especially important when elevated roadways are erected over existing bridges.

Similarly, light-weight forms and materials may be introduced during restoration of deteriorated existing structural members, for example, concrete traffic barriers may be replaced by much lighter aluminum barriers or concrete roadway decks may be replaced by steel orthotropic decks.

This object is also achieved by reducing the live load applied to new elevated roadways as well as to existing roadways. This live load reduction is realized by restricting elevated roadway traffic to "passenger cars only" traffic and by restricting existing roadway truck traffic to a minimal number of existing travel lanes as specified by the transportation authority. Since a per-lane live load imposed by truck traffic is several times higher than a per-lane live load imposed by "passenger cars only" traffic, it is possible to erect a new elevated roadway carrying several additional "passenger cars only" travel lanes without overloading an existing structure.

Another object of this invention is to achieve a higher level of safety for workers and motorists during reconstruction of existing roadways, as well as for motorists after the reconstruction is completed. This object is accomplished by adding a sufficient number of new travel lanes, therefore reducing congestion and upgrading Level-Of-Service.

A higher level of safety is also achieved by allowing "passenger cars only" traffic on new elevated roadways, thus separating car and truck traffic. Also, natural lines of separating truck and "passenger cars only" traffic are provided on the existing roadways by lines of columns of main frames protected by traffic barriers.

Safety is also improved because construction equipment, materials and personnel need not be moved often to and from work areas, and the workers are protected from traffic by construction traffic barriers.

Safety for traveling public is also increased during Stage B of reconstructing because a number of different temporary traffic patterns are minimized and the established traffic patterns are utilized during periods of peak and off-peak traffic, helping drivers adapt quickly.

Furthermore, a separate travel lane designated for "emergency vehicles only" may be integrated as a safety feature as well.

Other objects, advantages and novel features of the invention will become more apparent from the following detailed description of the invention when taken in conjunction with the following examples and accompanying drawings.

DRAWINGS

Drawing Figures

In the drawings, closely related figures have the same number but different alphabetic suffixes. Likewise, closely related reference numerals have the same number but different alphabetic suffixes.

Also in the drawings:

North direction shown thus: N direction of traffic on existing roadway shown thus:

direction of traffic on new elevated roadway shown thus:

direction of movement of moveable ramp unit shown thus:

travel lane marking lines shown thus:- - - roadway traffic barriers shown thus:— construction traffic barriers shown thus:

bridge roadway restoration area shown thus:

REFERENCE NUMERALS IN DRAWINGS

Figure 1:
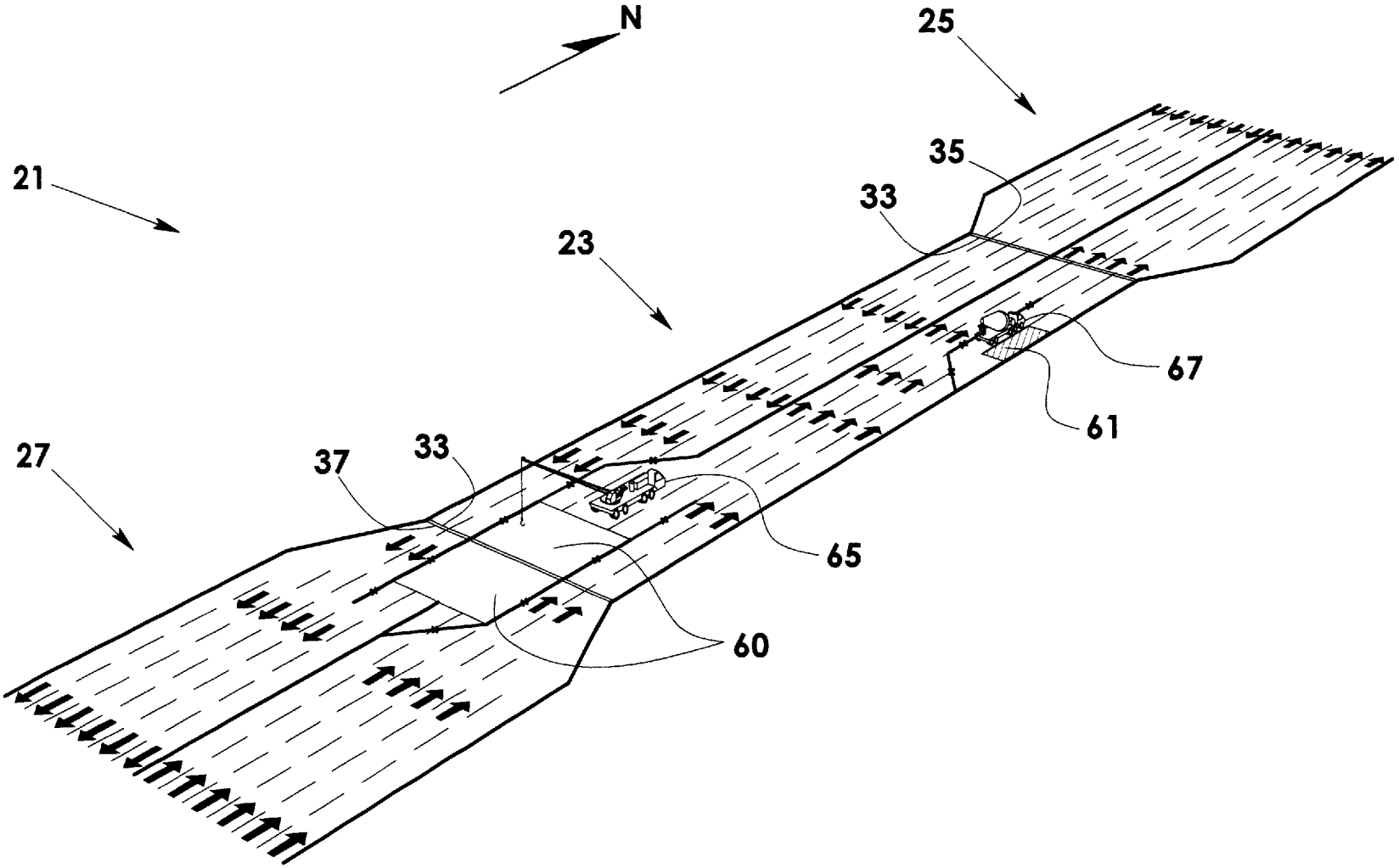
FIG. 1 (PRIOR ART)
FIG. 1 (PRIOR ART) shows a perspective view of an existing roadway that is being reconstructed utilizing prior art methods.

21 existing roadway
23 existing bridge roadway
25 existing north approach roadway
27 existing south approach roadway
33 existing bridge roadway limit line
35 existing north approach roadway limit line
37 existing south approach roadway limit line
39E, 39W local roadway
40 initial portion of new elevated roadway
40A, 40C extended portion of new elevated roadway
41 new elevated roadway
42, 43 alternative new elevated roadway
44 additional new elevated roadway
45 moveable ramp unit
46 ramp unit
47A, 47B, 47C, 47F, 47G bridging unit with portal-type main frame

47M, 47N bridging unit with double-T-type main frame
48A, 48B additional bridging unit
49A, 49B additional ramp unit
50 existing load-carrying structural member
51 portal-type main frame of bridging unit
53 double-T-type main frame of bridging unit
55 T-type main frame of bridging unit
57 base sub-unit of bridging unit
58 elevated sub-unit of bridging unit
60 new elevated roadway construction work area (prior art)
61 bridge roadway restoration area (prior art)
63A, 63B bridge roadway restoration area
65 construction equipment
66 contractor's field office
67 restoration equipment

DETAILED DESCRIPTION

Description and Operation of Preferred Embodiment

In the first example, FIG. 1 (PRIOR ART) shows a perspective view of an existing roadway 21 running north-south. Roadway 21, which is governed by a transportation authority, includes an existing bridge roadway 23, limited by existing bridge roadway limit lines 33. Roadway 21 also includes an existing north approach roadway 25, limited by an existing north approach roadway limit line 35, and an existing south approach roadway 27, limited by an existing south approach roadway limit line 37. Travel lane marking lines delineate existing northbound travel lanes and existing southbound travel lanes. The northbound and southbound travel lanes are separated at a median and limited on sides by roadway traffic barriers.

Existing traffic on roadway 21 fluctuates between periods of peak traffic, from early morning to late afternoon, and periods of off-peak traffic, during night hours. While average daily traffic requires four travel lanes in each direction, peak traffic requires six travel lanes in each direction, and off-peak traffic requires two travel lanes in each direction. Approach roadways 25 and 27 have been widened in order to satisfy peak traffic, that is, they provide six northbound travel lanes and six southbound travel lanes. However, widening of bridge roadway 23 could not be implemented due to environmental restrictions, so that it provides four northbound travel lanes and four southbound travel lanes.

Bridge roadway 23 is heavily deteriorated and requires restoration of its structural integrity; it is also deficient in traffic capacity during periods of peak traffic.

A conceivable solution for reconstructing bridge roadway 23 in order to restore its structural integrity with minimal disruption of existing traffic is first erecting a new elevated roadway with two elevated travel lanes in each direction. Existing traffic is then rerouted from existing roadway travel lanes onto the new elevated roadway, thus enabling restoration of structural integrity of the existing roadway travel lanes to be performed with minimal disruption of existing traffic. The start-up of such erecting using prior art methods is shown in FIG. 1 (PRIOR ART). It can be seen that a new elevated roadway construction work area 60 and construction equipment 65, protected by construction traffic barriers, are severely disrupting existing traffic on bridge roadway 23 by leaving only two travel lanes in each direction open to existing traffic. As erection will progress north using prior art methods, traffic disruption will continue for the duration of erecting the new elevated roadway.

It can also be seen in FIG. 1 (PRIOR ART) near the northern end of bridge roadway 23, that restoration of bridge roadway 23 is also being implemented using prior art methods. It is evident that a bridge roadway restoration area 61 and restoration equipment 67, protected by construction traffic barriers, are disrupting existing traffic by leaving only two travel lanes open to northbound traffic on bridge roadway 23. In order for this restoration to be of minimal disruption of existing traffic, the work must be performed and completed overnight and restoration equipment 67 and the construction traffic barriers have to be removed from bridge roadway 23 by early morning in time for the next period of peak traffic. The restoration work, therefore, will be performed during night hours, in substandard working conditions, and at a higher cost, longer duration, and lower quality, than if the roadway reconstructing methods of the present invention were utilized.

The following text and drawings provide a complete description of the roadway reconstructing methods of the present invention. First, in Stage A, a new elevated roadway 41 (see FIG. 5B) is erected from ramp units and bridging units above existing roadway 21, and then, in Stage B, existing traffic is rerouted from bridge roadway 23 onto elevated roadway 41 and bridge roadway 23 is restored with minimal disruption of existing traffic.

According to standard practice erecting work procedures include but are not limited to directing and maintaining existing traffic, moving all necessary construction equipment and devices to work areas, surveying and making necessary adjustments to existing roadways, constructing, installing, connecting and disconnecting ramp units and bridging units, and removing construction equipment and devices from the roadways prior to opening them to existing traffic. Likewise, according to standard practice roadway restoring work procedures include but are not limited to directing and maintaining existing traffic, moving all necessary restoration equipment and devices to work areas, surveying and making necessary adjustments to existing roadways, constructing, rebuilding, reinforcing, repairing, rehabilitating or replacing existing roadway deck and/or existing structural members, and removing restoration equipment and devices from the roadways prior to opening them to existing traffic.

The new elevated roadway will comprise a predetermined number of interconnected entrance/exit ramp units and bridging units. For clarity of presenting the novel method of the present invention, the ramp units and the bridging units are shown in the majority of the drawings as undivided units. Actually, they will most likely be erected from individual structural members such as frames, beams, and deck panels, or from pre-assembled sub-units. However, regardless of the actual pattern of erecting the new elevated roadway, the terms, ramp unit(s) and bridging unit(s), will be utilized.

Figure 2A:
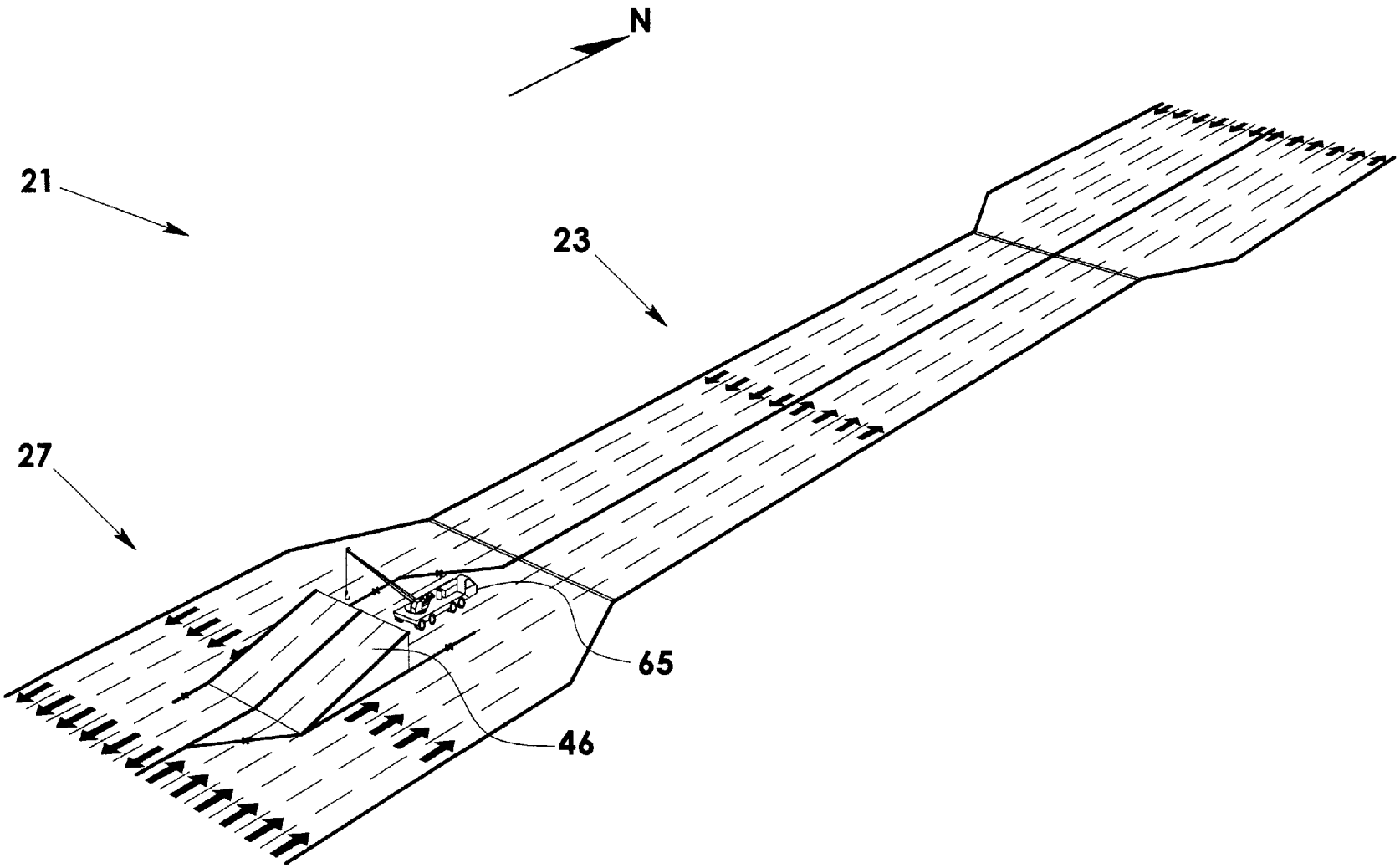
FIGS. 2A and 2B show perspective views of the existing roadway during an initial step of erecting a new elevated roadway.
Figure 2B:
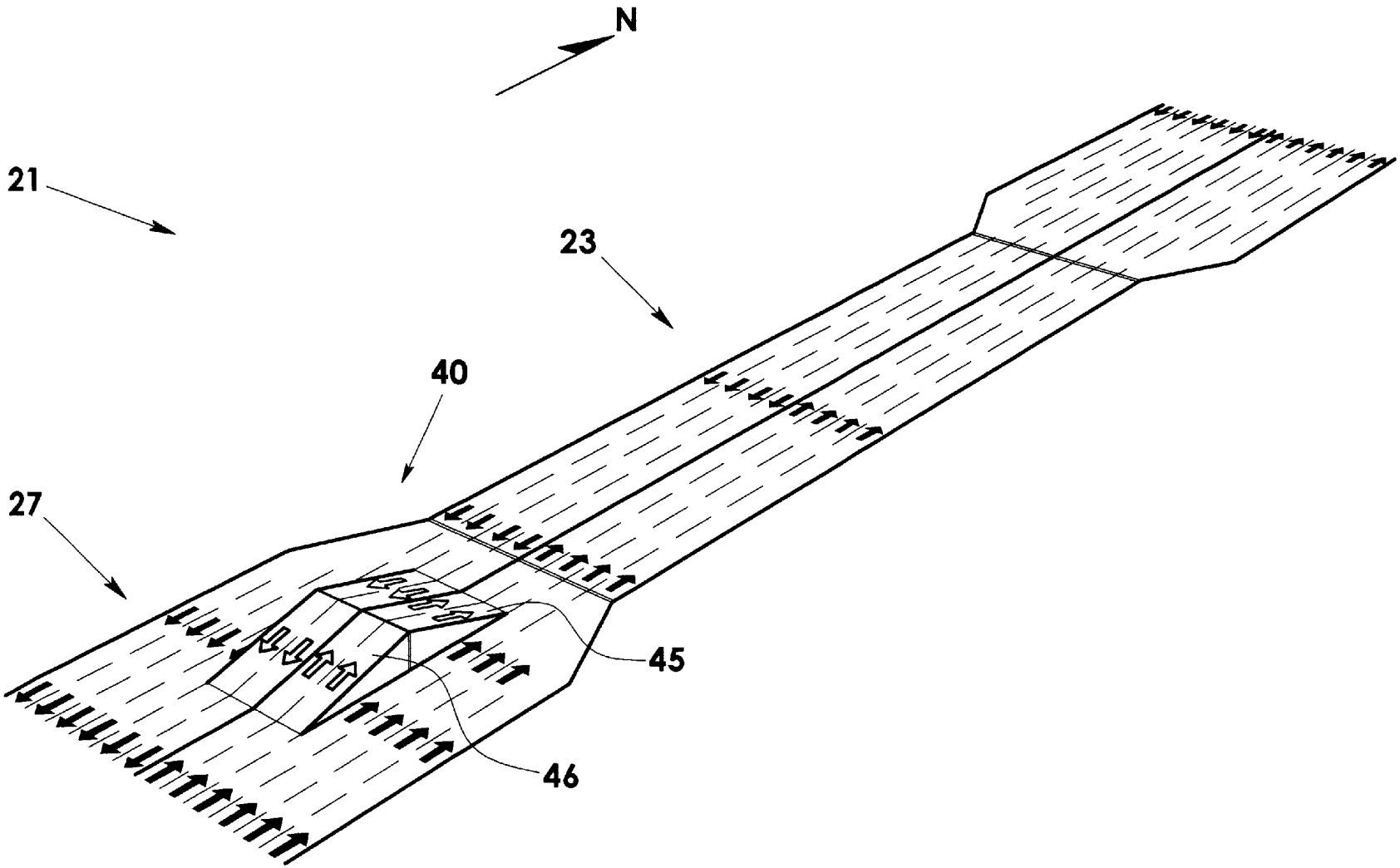

FIGS. 2A and 2B show perspective views of the same existing roadway 21 during an initial step of Stage A of reconstructing roadway 23. According to the preferred embodiment of the present invention, this initial step comprises the erecting of two entrance/exit ramp units, one of which is a moveable ramp unit.

The moveable ramp unit will most likely be composed of several subunits, which will be joined together by fixed or flexible connections. The moveable ramp unit may be required to be flexible longitudinally, transversely, and vertically in order to provide for an existing roadway's horizontal and vertical curve alignments and varying cross-slopes. The subunits may be supported by rollers, sliders, pneumatic wheels, or other means, may be mounted on trailer-type platforms, or may run on a light rail-type system. The moveable ramp unit may be self-propelling, or it may be propelled along the existing roadway by an outside source, like a tractor or a cable-winch system. The moveable ramp unit may be moved as a single unit or the sub-units can be moved in sequential order, thereby reducing power requirements.

Space underneath the moveable ramp unit can be used to stage construction work, store construction means, such as construction equipment and traffic barriers, and house a contractor's field office. This greatly minimizes the need to repeatedly move construction means and workers to and from the actual construction work area, thus reducing non-productive work, time loss, and disruption of existing traffic.

The erection, as seen in FIG. 2A, involves closing four center travel lanes (two leftmost lanes in each direction) on approach roadway 27 to existing traffic by using construction traffic barriers, moving in construction equipment 65, and erecting a ramp unit 46.

As shown in FIG. 2B, a moveable ramp unit 45 has been erected next to ramp unit 46 so that an uppermost end of ramp unit 45 faces an uppermost end of ramp unit 46. It can also be seen that the construction traffic barriers have been removed from approach roadway 27, and an initial portion of new elevated roadway 40, providing two new elevated northbound travel lanes and two new elevated southbound travel lanes, is open to existing traffic as specified by the governing transportation authority.

During the erection of ramp units 45 and 46, as seen in FIGS. 2A and 2B, at least four travel lanes in each direction remained open to existing traffic on approach roadway 27 and bridge roadway 23. And since bridge roadway 23 provided four travel lanes in each direction prior to the beginning of erecting the new elevated roadway, ramp units 45 and 46 have been erected with minimal disruption of existing traffic.

Figure 3A:
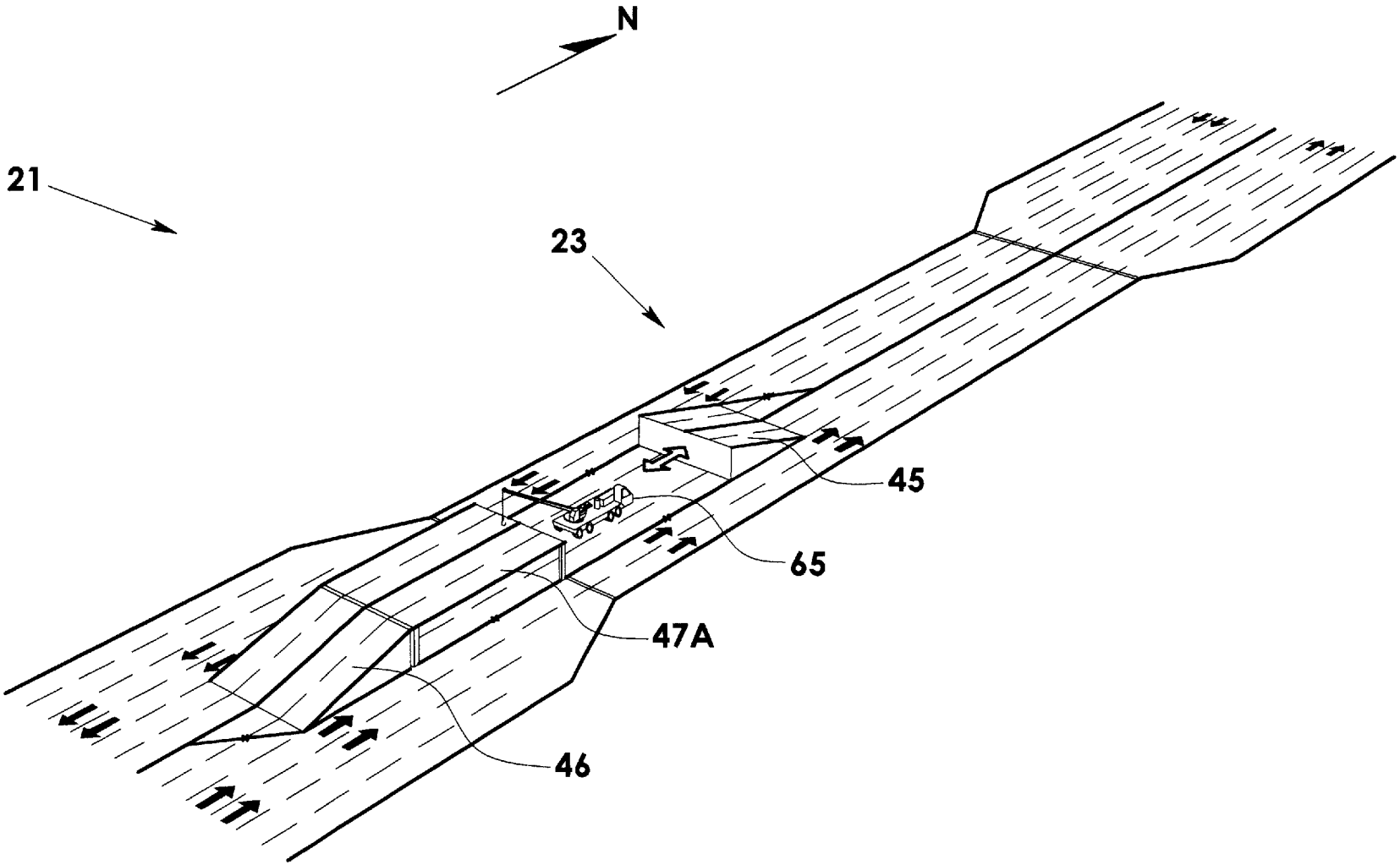
FIGS. 3A and 3B show perspective views of the existing roadway during a subsequent step of erecting the new elevated roadway.
Figure 3B:
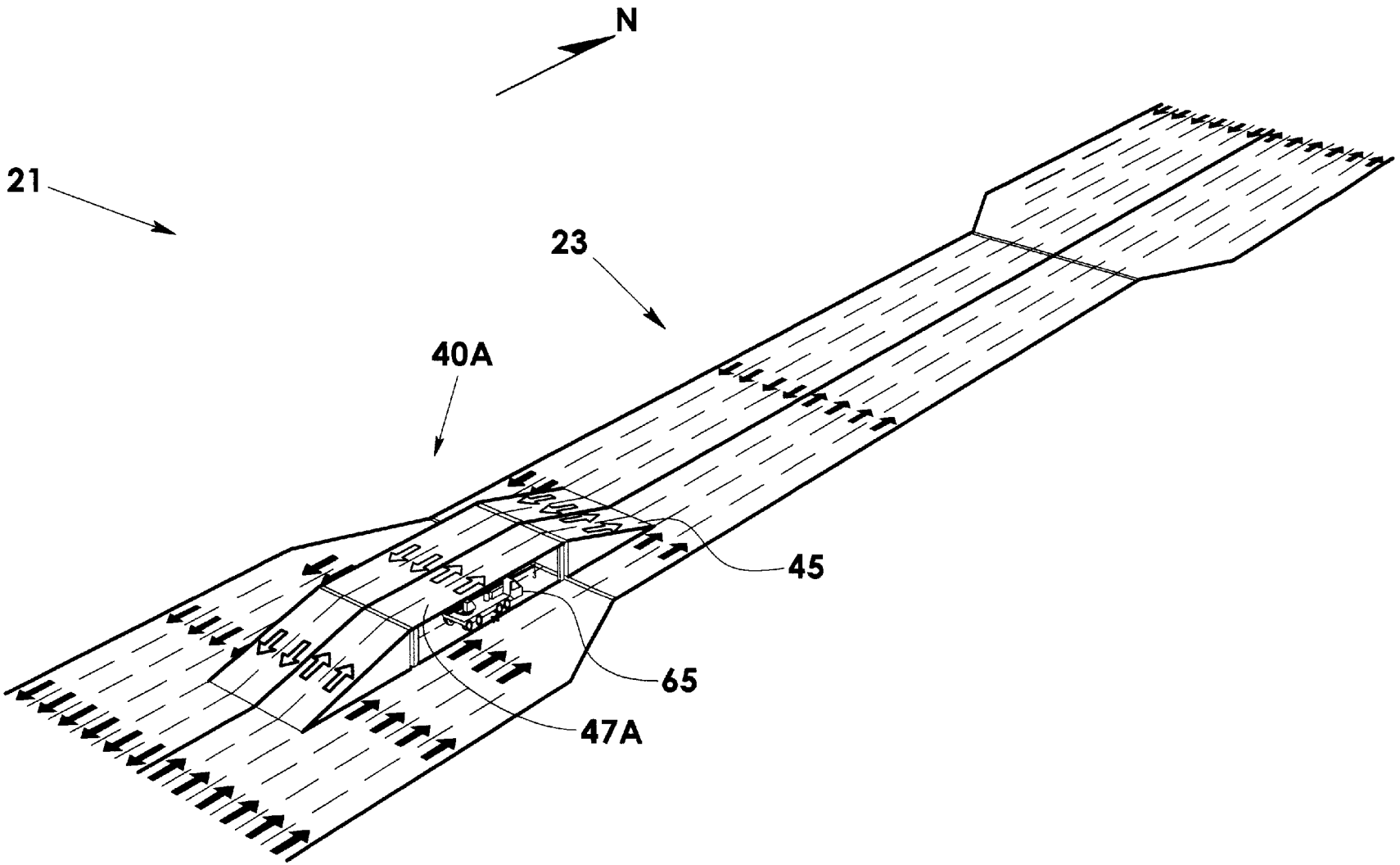

FIGS. 3A and 3B show perspective views of existing roadway 21 during a subsequent step of erecting the new elevated roadway, which is the erection of a bridging unit 47A. As shown in FIG. 3A, this erecting involves closing the previously erected initial portion of the new elevated roadway to existing traffic during a period of off-peak traffic as specified by the transportation authority, and creating a gap between ramp unit 45 and ramp unit 46 by moving ramp unit 45 along existing roadway 21. Then, construction equipment 65 is moved in, and bridging unit 47A is erected.

As seen in FIG. 3B, construction equipment 65 has been stored under the newly erected bridging unit 47A, ramp unit 45 has been moved back along existing roadway 21 to adjoin bridging unit 47A, construction traffic barriers have been removed from existing roadway 21, and an extended portion of new elevated roadway 40A is opened in time for the next period of peak traffic as specified by the transportation authority.

As shown in FIG. 3A, two travel lanes in each direction are open to exiting traffic on bridge roadway 23 during erection of bridging unit 47A. And, since off-peak traffic requires only two travel lanes in each direction, bridging unit 47A is erected with minimal disruption of existing traffic.

As seen in FIG. 3B, two new elevated travel lanes in each direction are open to existing traffic in addition to two existing travel lanes in each direction on bridge roadway 23; therefore, four travel lanes in each direction are available to existing traffic. This is equal to the traffic capacity of bridge roadway 23 (four travel lanes in each direction) prior to the beginning of erecting the new elevated roadway, therefore, disruption of existing traffic during this step of erecting is minimal.

Figure 4A:
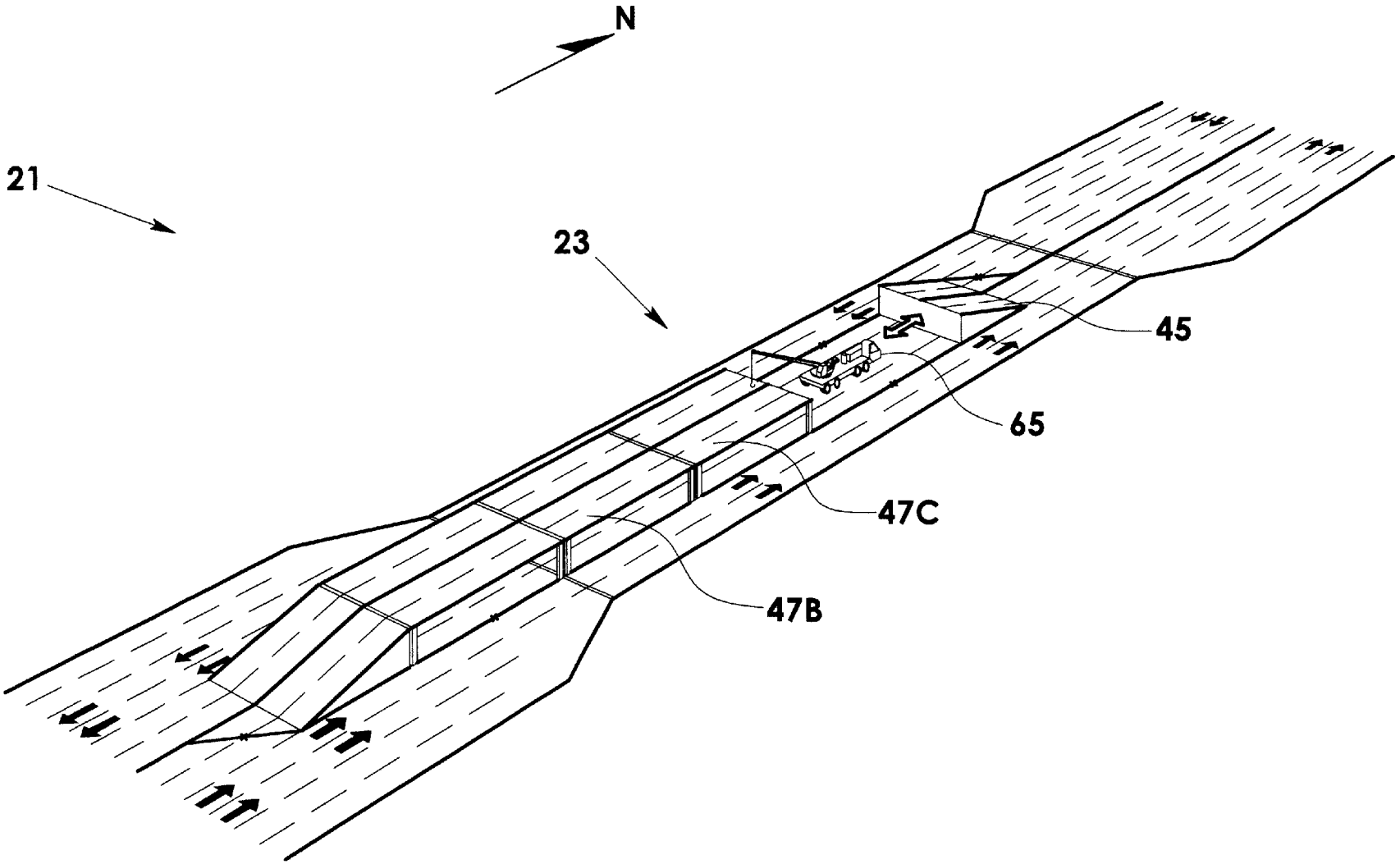
FIGS. 4A and 4B show perspective views of the existing roadway during an intermediate step of erecting the new elevated roadway.
Figure 4B:
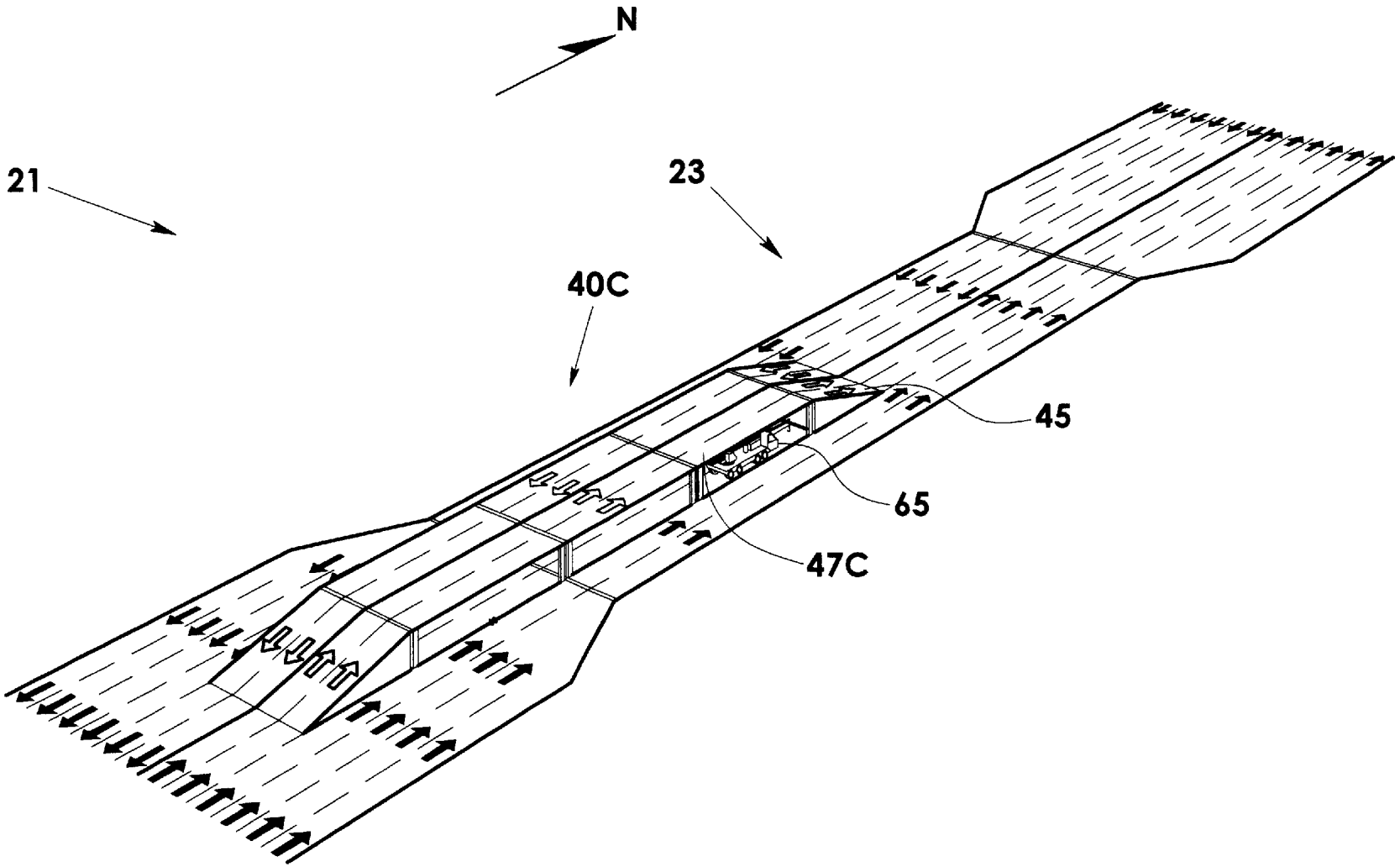

FIGS. 4A and 4B show perspective views of existing roadway 21 during an intermediate step of erecting the new elevated roadway, which is the erection of a bridging unit 47C. As shown in FIG. 4A, this erecting involves closing a previously erected portion of the new elevated roadway to existing traffic during a period of off-peak traffic as specified by the transportation authority, and creating a gap between a bridging unit 47B and ramp unit 45 by moving ramp unit 45 along existing roadway 21. Then, construction equipment 65 is moved in, and bridging unit 47C is erected.

As seen in FIG. 4B, construction equipment 65 has been stored under the newly erected bridging unit 47C, ramp unit 45 has been moved back along existing roadway 21 to adjoin bridging unit 47C, construction traffic barriers have been removed from existing roadway 21, and an extended portion of new elevated roadway 40C is opened in time for the next period of peak traffic as specified by the transportation authority.

As shown in FIG. 4A, two travel lanes in each direction are open to existing traffic on bridge roadway 23 during erection of bridging unit 47C. And, since off-peak traffic requires only two travel lanes in each direction, bridging unit 47C is erected with minimal disruption of existing traffic.

As seen in FIG. 4B, two new elevated travel lanes in each direction are open to existing traffic in addition to two existing travel lanes in each direction on bridge roadway 23; therefore, four travel lanes in each direction are available to existing traffic. This is equal to the traffic capacity of bridge roadway 23 (four travel lanes in each direction) prior to the beginning of erecting the new elevated roadway, therefore, traffic disruption during this step of erecting is minimal.

Subsequent bridging units are erected in the same manner as described above for bridging unit 47C.

Figure 5A:
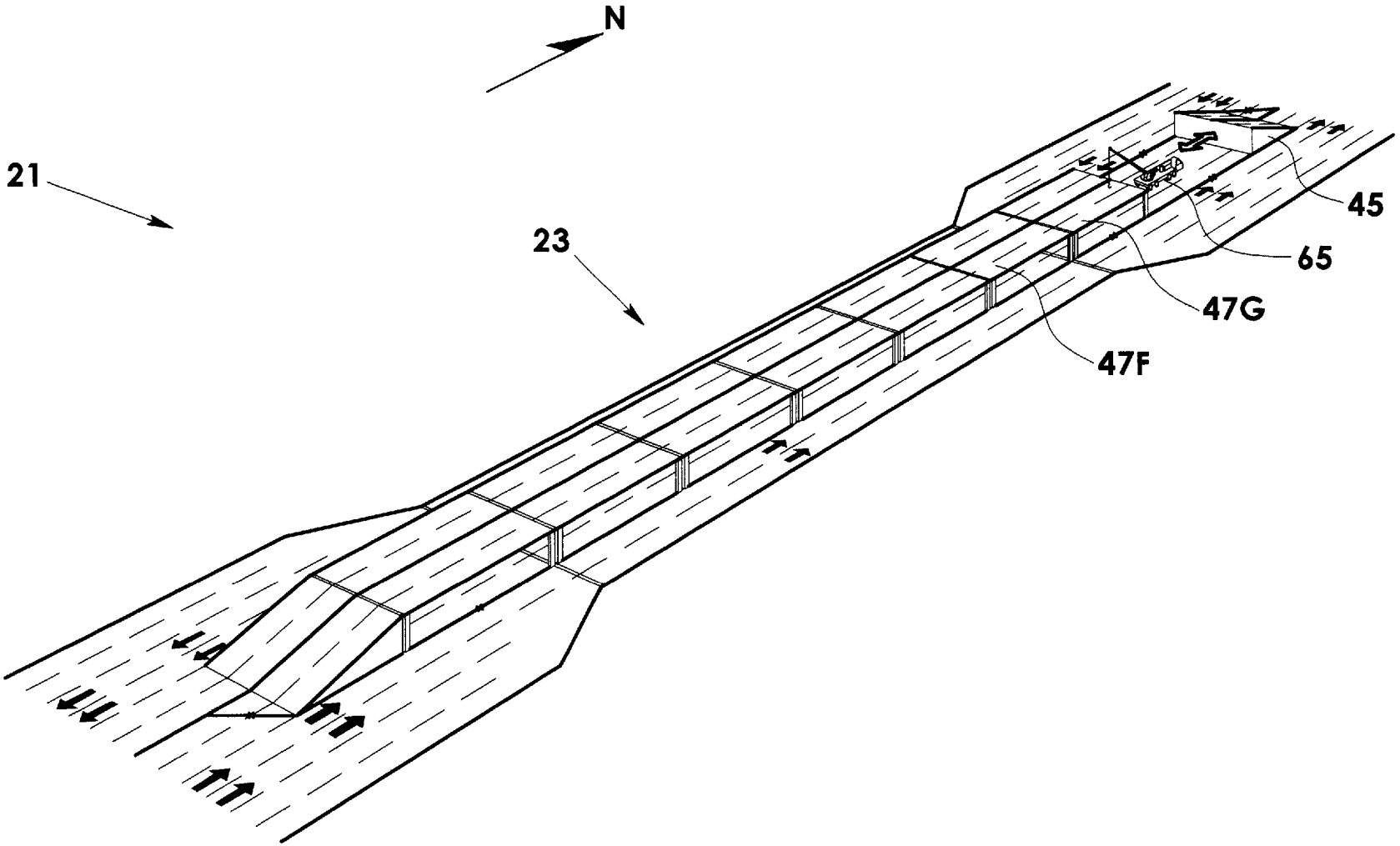
FIGS. 5A and 5B show perspective views of the existing roadway during the final step of erecting the new elevated roadway.
Figure 5B:
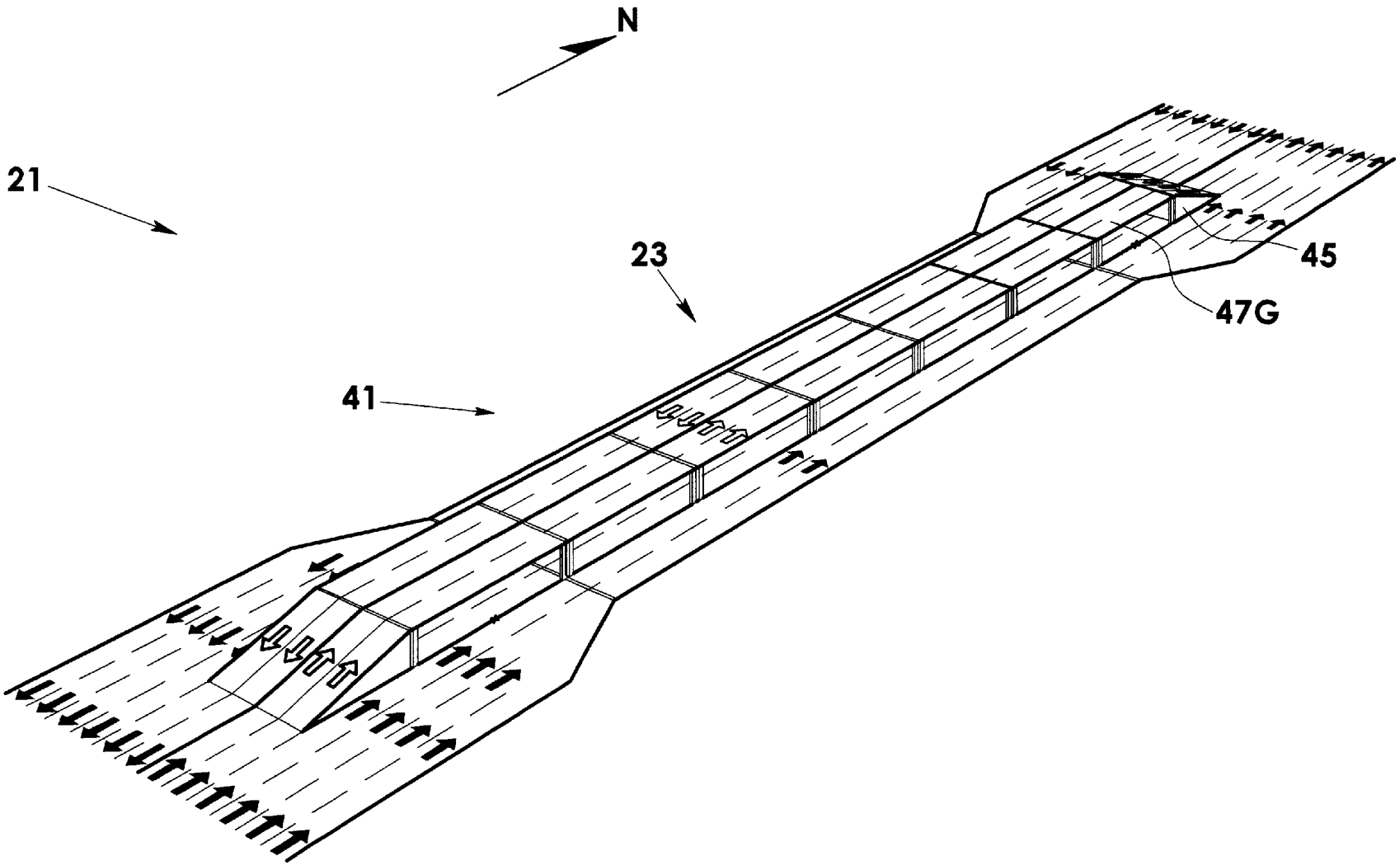

FIGS. 5A and 5B show perspective views of roadway 21 during the final step of erecting the new elevated roadway, which is the erection of a bridging unit 47G. As shown in FIG. 5A, this erecting involves closing a previously erected portion of the new elevated roadway to existing traffic during a period of off-peak traffic as specified by the transportation authority, and creating a gap between a bridging unit 47F and ramp unit 45 by moving ramp unit 45 along existing roadway 21. Then, construction equipment 65 is moved in, and bridging unit 47G is erected.

As seen in FIG. 5B, the construction equipment has been removed from existing roadway 21, ramp unit 45 has been moved back along roadway 21 to adjoin bridging unit 47G and has been fixed to existing roadway 21, construction traffic barriers have been removed from existing roadway 21, and elevated roadway 41 is opened in time for the next period of peak traffic as specified by the transportation authority.

As shown in FIG. 5A, two travel lanes in each direction are open to existing traffic on bridge roadway 23 during erection of bridging unit 47G. And, since off-peak traffic requires only two travel lanes in each direction, bridging unit 47G is erected with minimal disruption of existing traffic.

As seen in FIG. 5B, two new elevated travel lanes in each direction are open to existing traffic in addition to two existing travel lanes in each direction on bridge roadway 23; therefore four travel lanes in each direction are available to existing traffic. This is equal to the traffic capacity of bridge roadway 23 (four travel lanes in each direction) prior to the beginning of erecting the new elevated roadway, therefore disruption of existing traffic during this step of erecting, as well as during the erection of the entire new elevated roadway, is minimal.

As shown above, Stage A of reconstructing bridge roadway 23 was completed with minimal disruption of existing traffic. It is demonstrated below that Stage B of reconstructing, which involves restoring bridge roadway 23, will also be performed with minimal disruption of existing traffic.

Figure 6A:
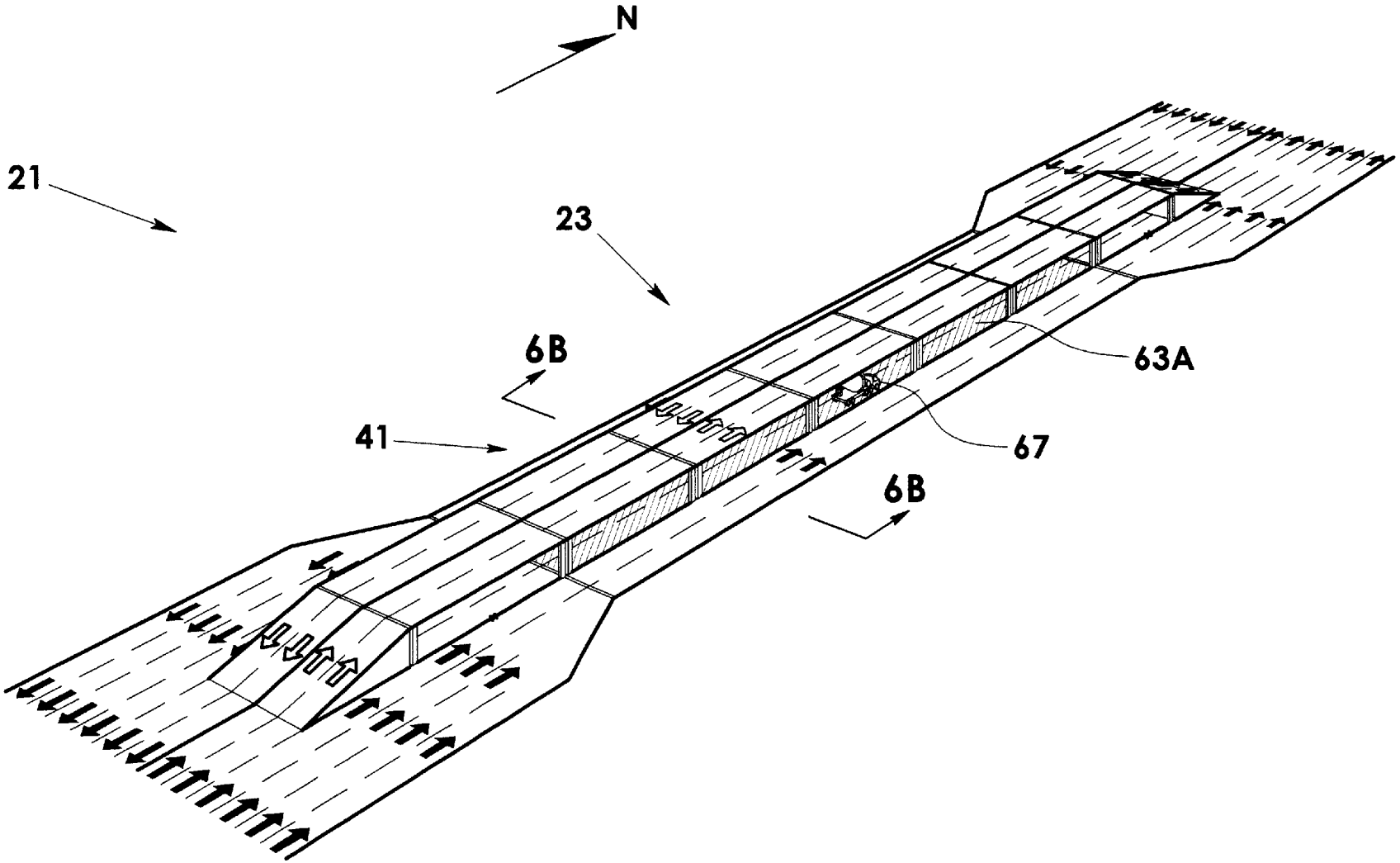
FIGS. 6A and 6B show a perspective view and a cross-sectional view, respectively, of the existing roadway and new elevated roadway during an initial step of restoring structural integrity of an existing bridge roadway.
Figure 6B:
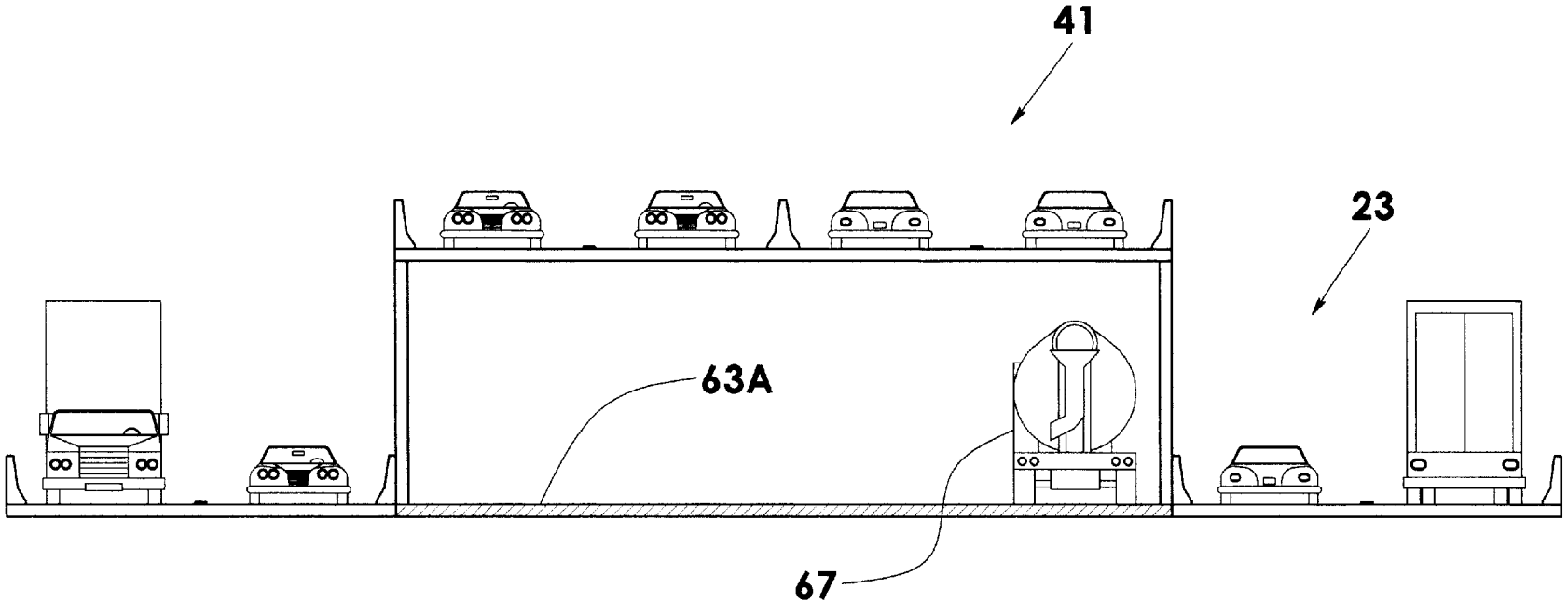
Figure 7A:
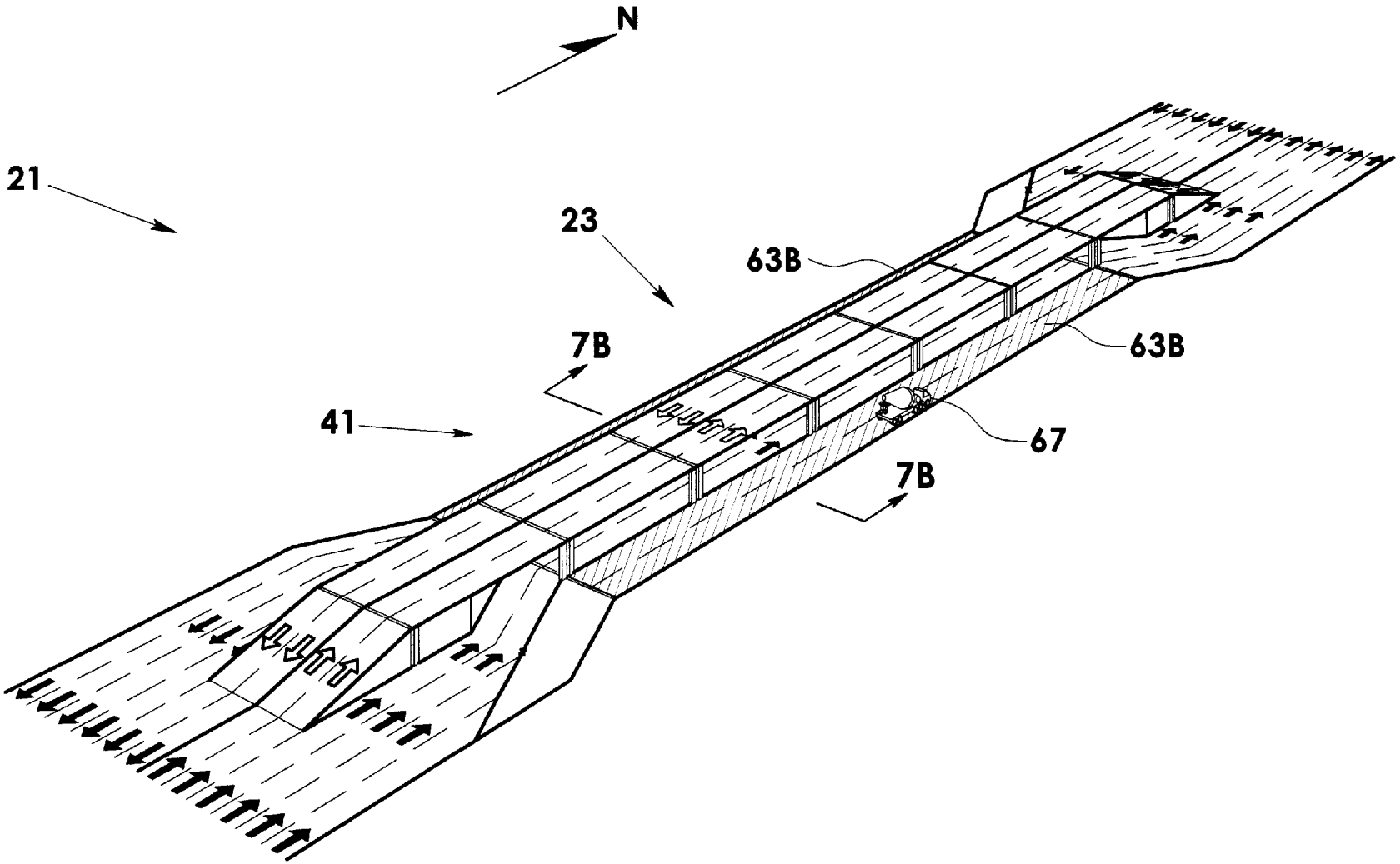
FIGS. 7A and 7B show a perspective view and a cross-sectional view, respectively, of the existing roadway and new elevated roadway during the final step of restoring structural integrity of the existing bridge roadway.
Figure 7B:
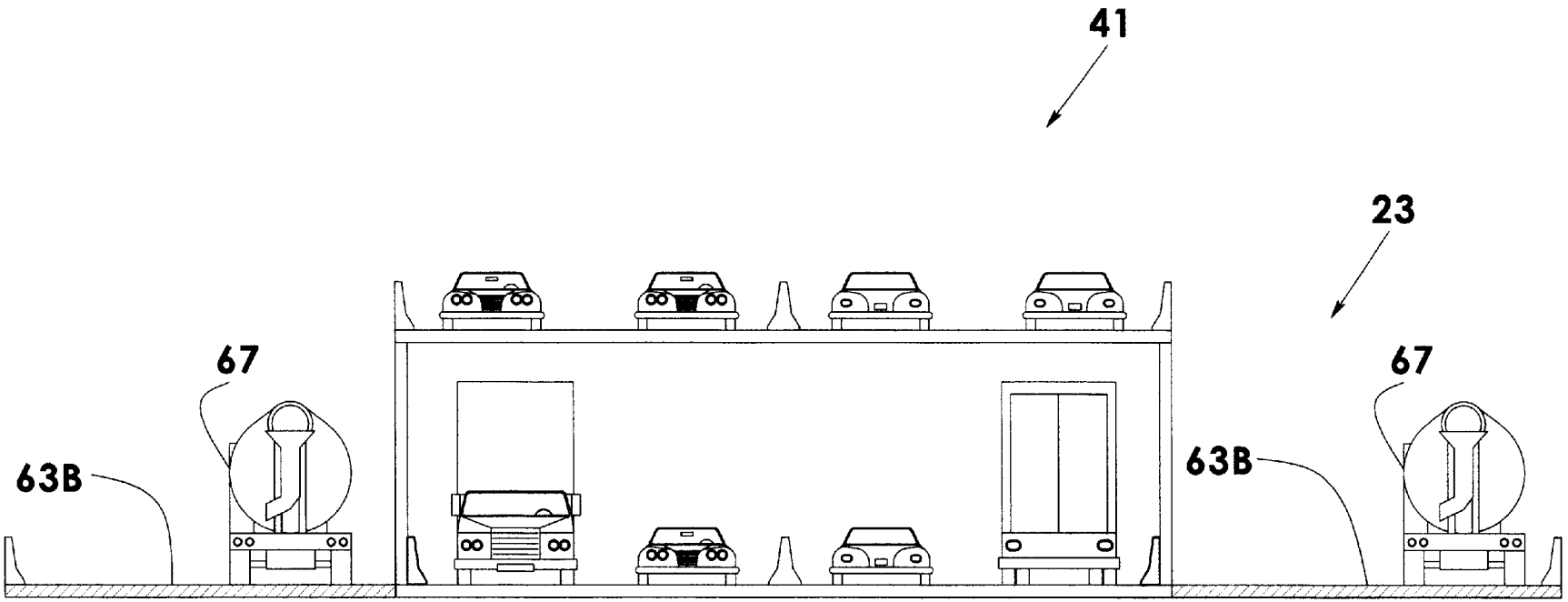

FIGS. 6A and 7A show perspective views of existing roadway 21 and elevated roadway 41 during two consecutive steps of restoring bridge roadway 23, respectively. FIGS. 6B and 7B show cross-sectional views (looking North) of bridge roadway 23 and elevated roadway 41 during the same two steps of restoring, respectively.

First, as shown in FIGS. 6A and 6B, a bridge roadway restoration area 63A within the limits of four existing center travel lanes (two leftmost lanes in each direction) is being restored. The restoration is performed by keeping the four center travel lanes closed to existing traffic (note that the traffic pattern shown in FIG. 5B has not been changed), moving in restoration equipment 67, and restoring structural integrity of bridge roadway 23 within the limits of restoration area 63A continuously, without interruptions.

While restoring bridge roadway 23 within the limits of restoration area 63A, two outer travel lanes in each direction of bridge roadway 23 are continuously open to existing traffic in addition to two elevated travel lanes in each direction of elevated roadway 41, providing a total of four travel lanes in each direction that are continuously open to existing traffic. Since a total of four travel lanes in each direction were available to existing traffic on bridge roadway 23 prior to erecting elevated roadway 41, the restoration of bridge roadway 23 within the limits of restoration area 63A is performed with minimal disruption of existing traffic.

Then, as shown in FIGS. 7A and 7B, a bridge roadway restoration area 63B within the limits of four existing outer travel lanes (two rightmost lanes in each direction) is being restored. The restoration is performed by closing the four outer travel lanes to existing traffic while rerouting existing traffic onto previously restored center travel lanes (note that the traffic pattern for elevated roadway 41 has not been changed), moving in restoration equipment 0.67, and restoring structural integrity of bridge roadway 23 within the limits of restoration area 63B continuously, without interruptions.

While restoring bridge roadway 23 within the limits of restoration area 63B, two center travel lanes in each direction of bridge roadway 23 are continuously open to existing traffic in addition to two elevated travel lanes in each direction of elevated roadway 41, providing a total of four travel lanes in each direction that are continuously open to existing traffic. Since a total of four travel lanes in each direction were available to existing traffic on bridge roadway 23 prior to erection of elevated roadway 41, the restoration of bridge roadway 23 within the limits of restoration area 63B is performed with minimal disruption of existing traffic.

Thereby, the entire restoration of structural integrity of bridge roadway 23 is completed with minimal disruption of existing traffic. And, since restoration work is performed continuously, during periods of peak and off-peak traffic, the restoration is completed in a fraction of time that prior art methods would require.

Figure 8A:
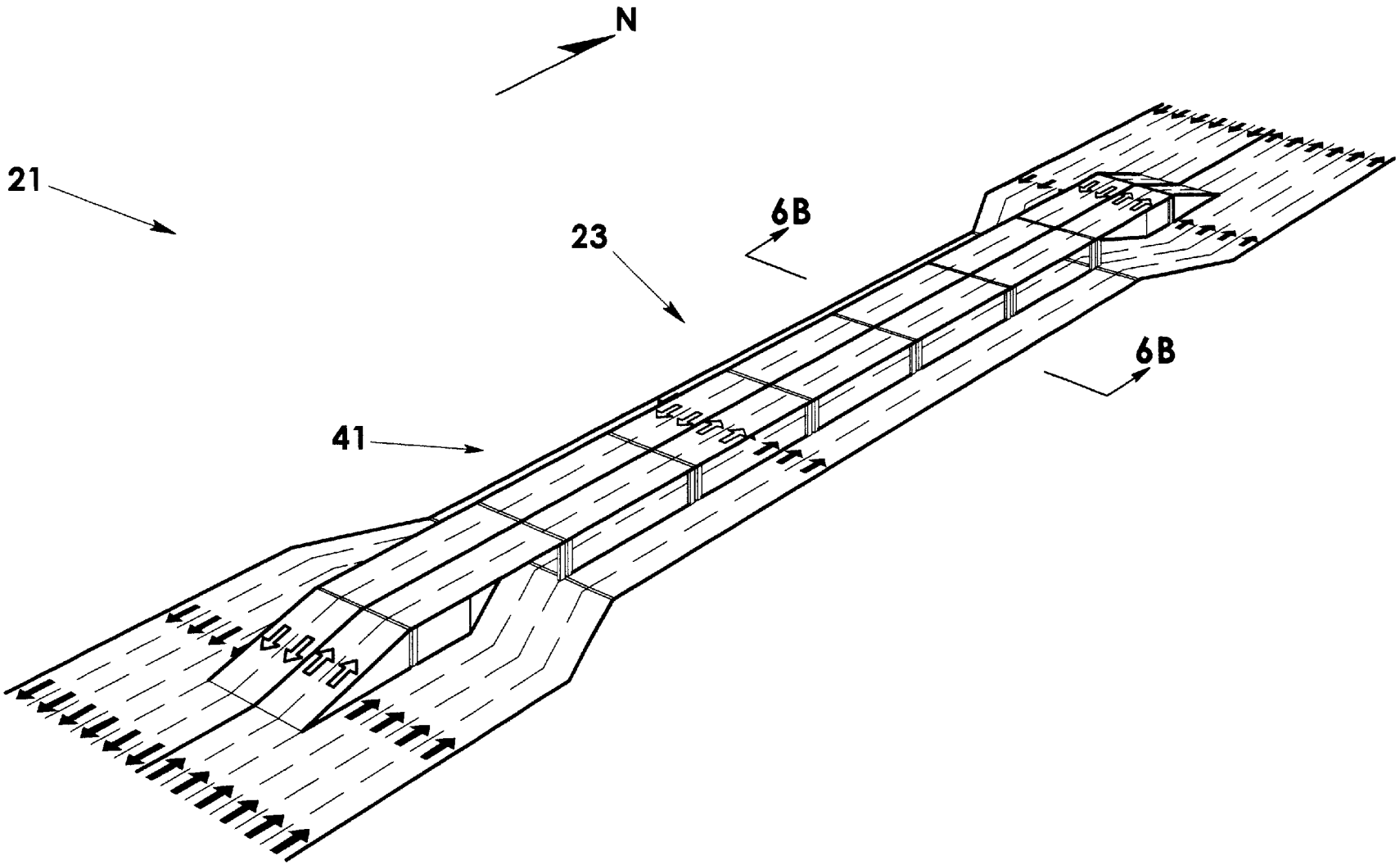
FIGS. 8A and 8B show a perspective view and a cross-sectional view, respectively, of the existing roadway and the new elevated roadway after erection of the new elevated roadway and restoration of the existing bridge roadway have been completed.

FIG. 8A shows a perspective view of existing roadway 21 after erection of elevated roadway 41 and restoration of structural integrity of bridge roadway 23 have been completed with minimal disruption of existing traffic. All eight travel lanes (four lanes in each direction) of the entirely restored bridge roadway 23 as well as all four travel lanes (two lanes in each direction) of elevated roadway 41 are open to existing traffic, providing a total of six travel lanes in each direction.

Figure 8B:
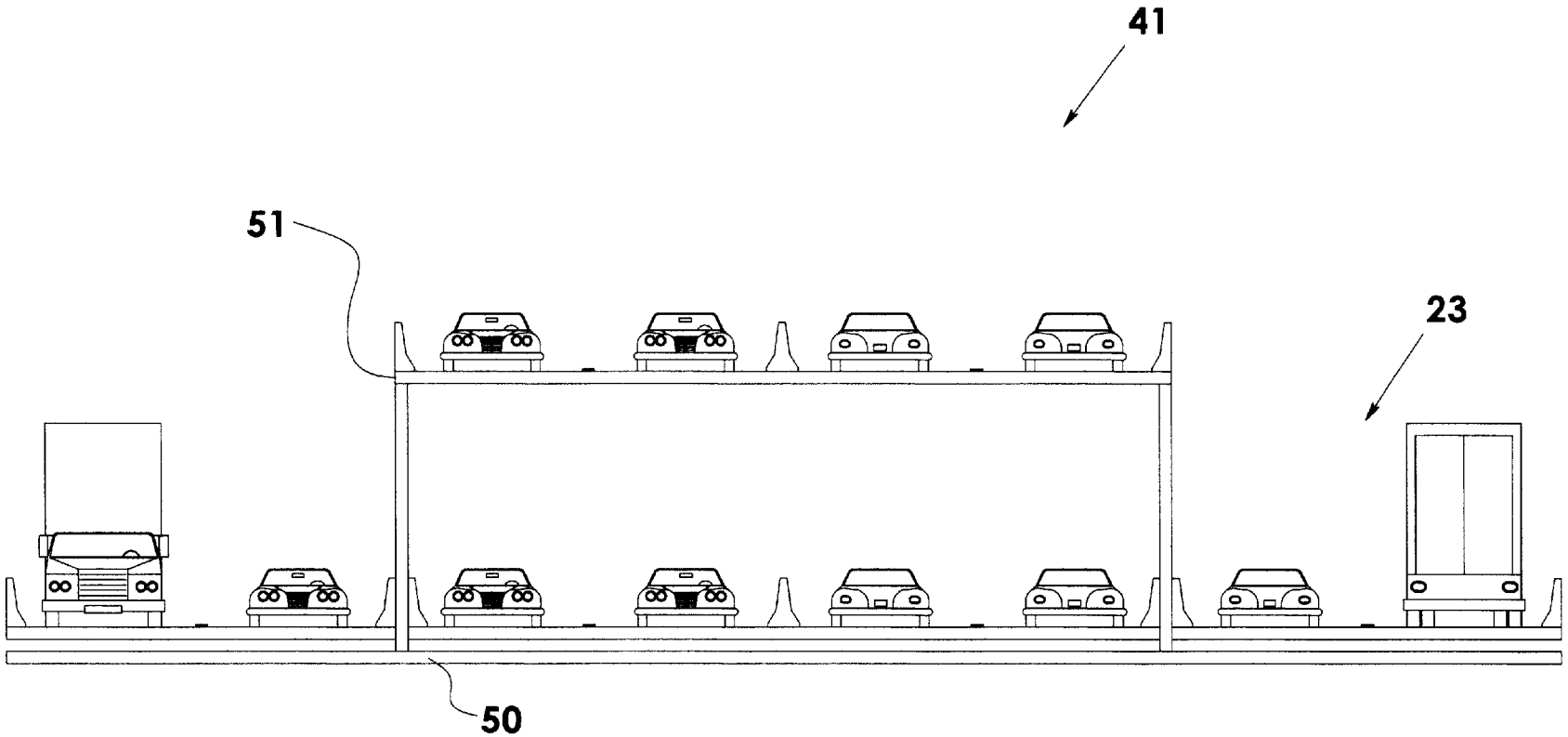

FIG. 8B shows a cross-sectional view (looking North) of bridge roadway 23 and elevated roadway 41 for the same traffic pattern as shown in FIG. 8A. It can be seen that elevated roadway 41 is erected from bridging units with portal-type main frames 51, which are supported by load-carrying members 50 of bridge roadway 23.

This type of main frame of bridging units is shown in all previous drawings; however, other types of main frames of bridging units may also be used in conjunction with the novel method of the present invention.

Figure 8C:
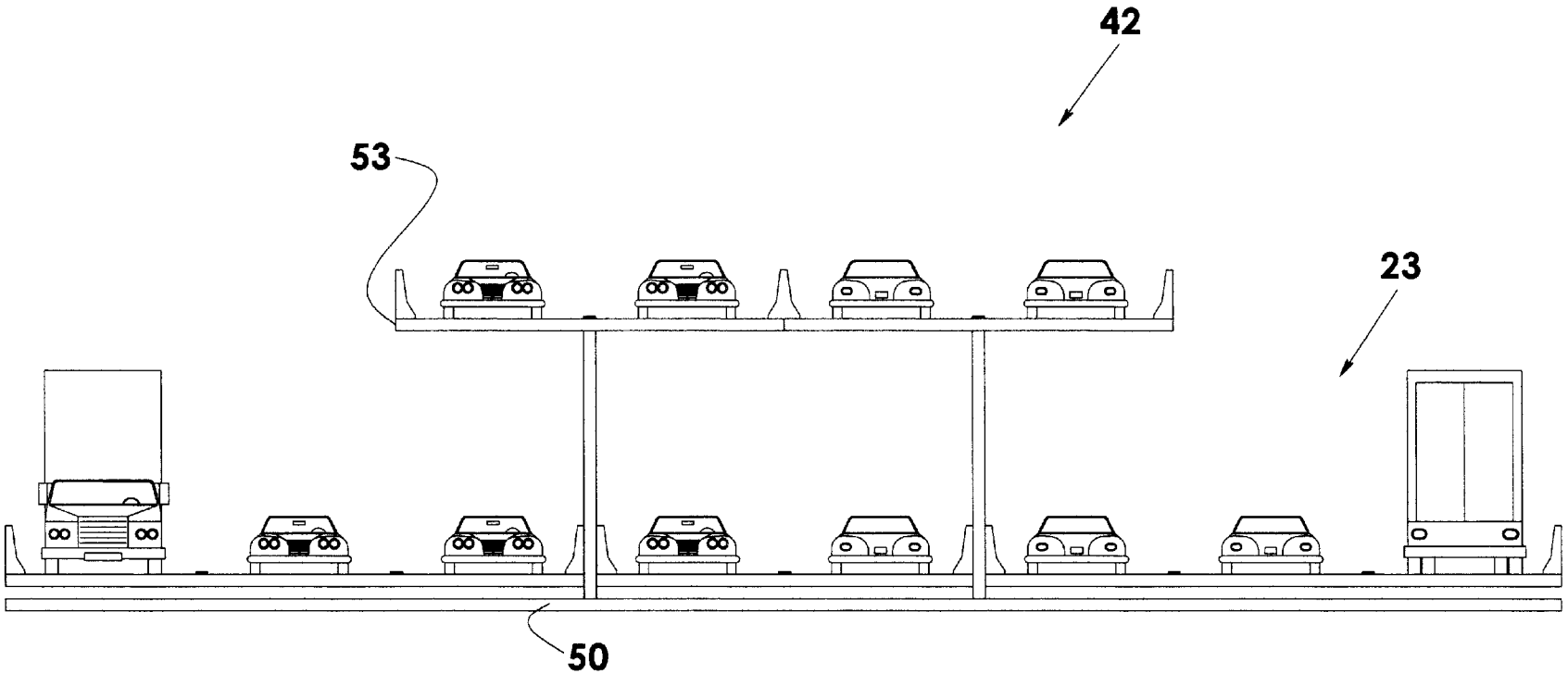
FIG. 8C shows a cross-sectional view of the existing roadway and an alternative new elevated roadway after erection of the alternative new elevated roadway and restoration of the existing bridge roadway have been completed.

FIG. 8C shows a cross-sectional view of bridge roadway 23 and an alternative new elevated roadway 42, erected from bridging units with double-T-type main frames 53, which are supported by load-carrying members 50 of bridge roadway 23.

Figure 8D:
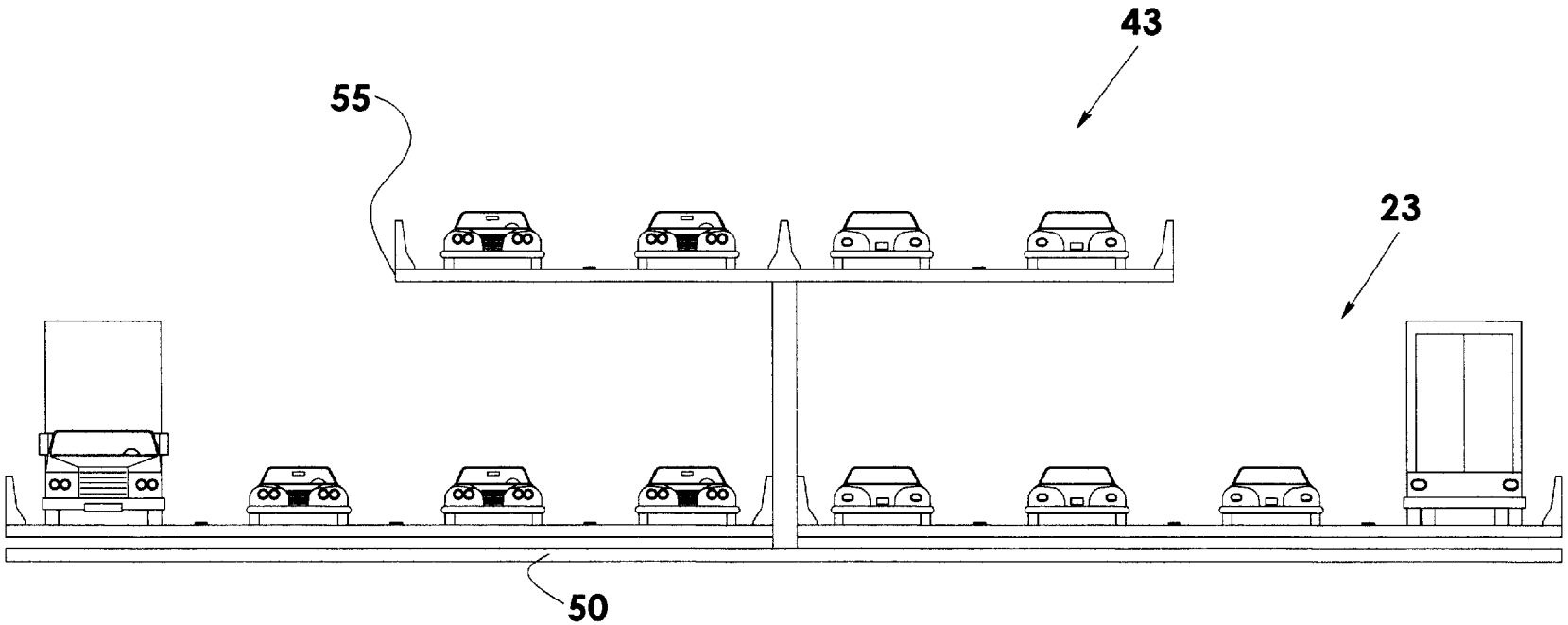
FIG. 8D shows a cross-sectional view of the existing roadway and an alternative new elevated roadway after erection of the alternative new elevated roadway and restoration of the existing bridge roadway have been completed.

FIG. 8D shows a cross-sectional view of bridge roadway 23 and an alternative new elevated roadway 43, erected from bridging units with T-type main frames 55, which are supported by load-carrying members 50 of bridge roadway 23.

DESCRIPTION AND OPERATION OF ADDITIONAL EMBODIMENTS

In the next example, an additional embodiment of Stage A of the method of reconstructing existing roadways is demonstrated. As mentioned before, Stage A of reconstructing comprises erecting a new elevated roadway above an existing roadway with minimal disruption of existing traffic.

This example assumes that two additional northbound travel lanes are required to be built along the same bridge roadway 23 in order to provide a connector road from a local roadway 39E to a local roadway 39W. This requirement may be satisfied by erecting an additional two-lane elevated roadway above the two rightmost northbound travel lanes of bridge roadway 23 and alongside the previously erected elevated roadway 41 using the preferred embodiment of the present invention. However, in the next example, an alternative method of erecting a new elevated roadway with minimal disruption of existing traffic will be utilized.

Accordingly, a new elevated roadway is erected above an existing roadway in multiple steps utilizing a predetermined number of ramp units and bridging units. This additional embodiment of the present invention provides a greater flexibility in the sequencing of erecting entrance/exit ramp units and bridging units than the preferred embodiment. Entrance/exit ramp units and bridging units are erected at predetermined locations at such a time that disruption of existing traffic will be minimal as specified by a governing transportation authority. Each step of erecting a bridging unit comprises closing a predetermined number of existing travel lanes to existing traffic during a period of off-peak traffic as specified by the transportation authority, erecting at least one bridging unit over the closed existing travel lanes, and opening the previously closed travel lanes beneath the erected portion of the new elevated roadway to existing traffic in time for the next period of peak traffic as specified by the transportation authority.

This alternative method is further described in the following text and FIGS. 9A, 9B, and 9C, which show perspective views of existing roadway 21, elevated roadway 41, and local roadways 39E and 39W during various steps of erecting an additional new elevated roadway 44 with minimal disruption of existing traffic on bridge roadway 23.

Figure 9A:
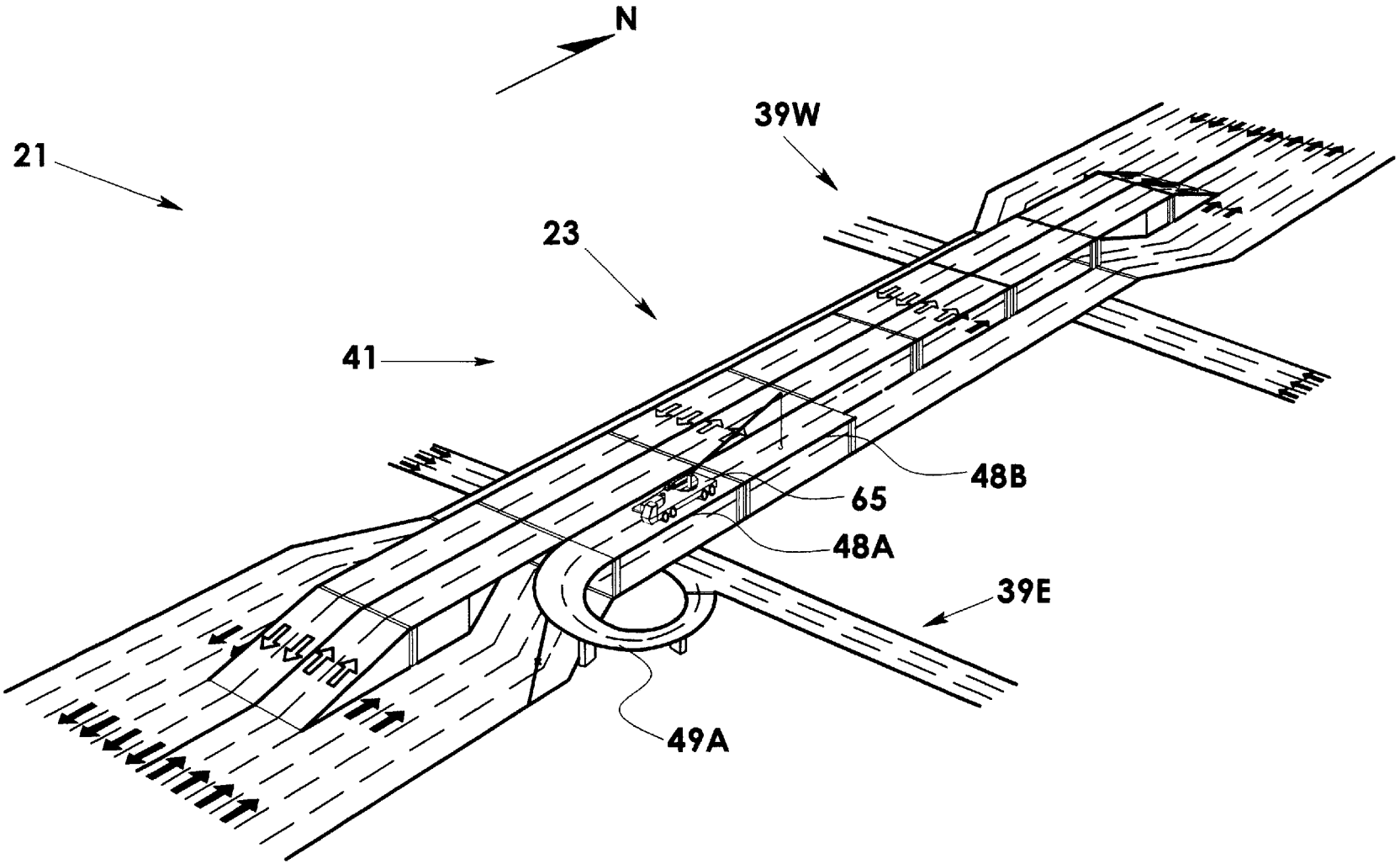
FIGS. 9A and 9B show perspective views of the existing roadway, new elevated roadway, and two local roadways during erection, in two consecutive sub-steps, respectively, of a bridging unit of an additional new elevated roadway.
Figure 9B:
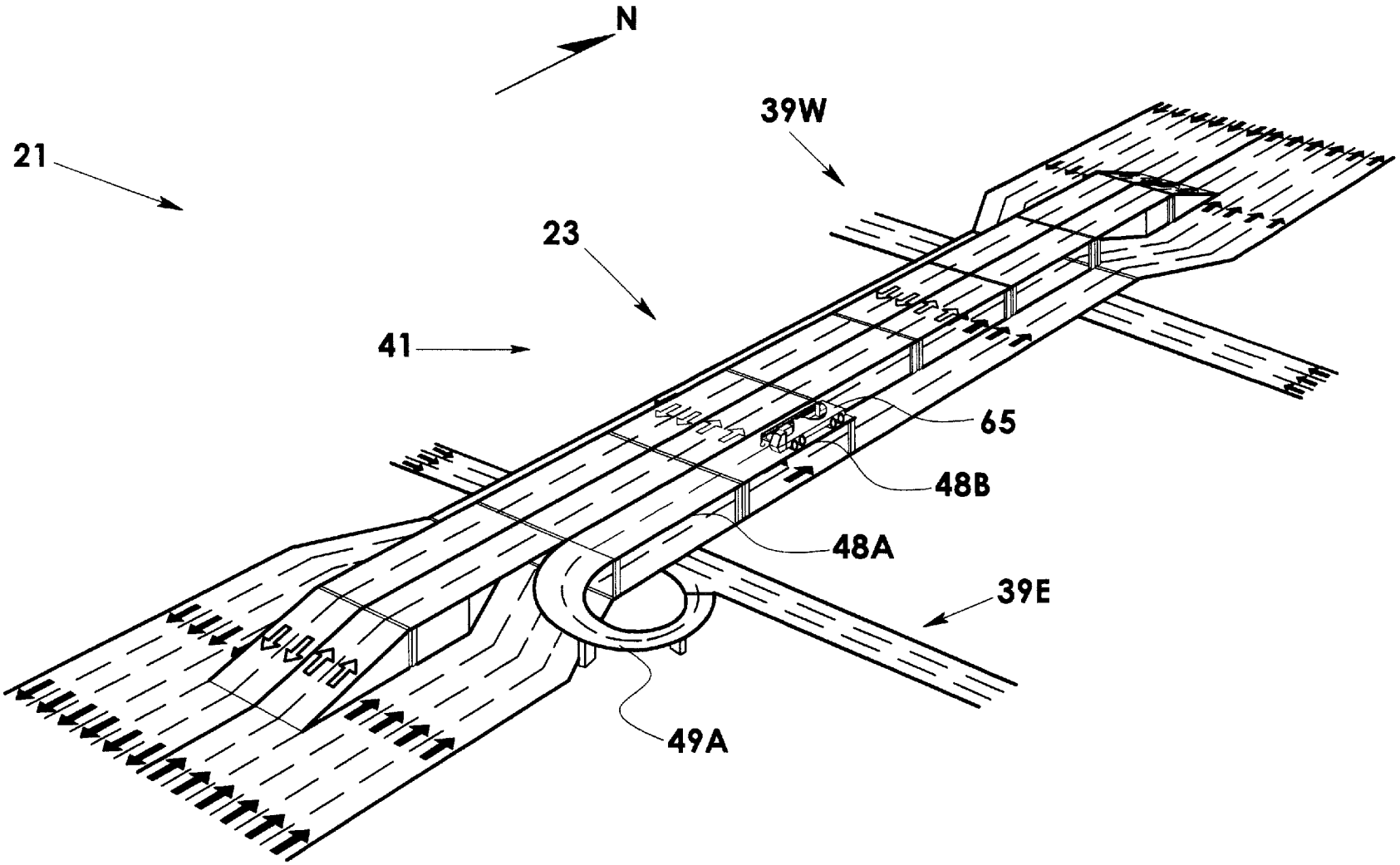

FIGS. 9A and 9B show two consecutive sub-steps, respectively, of erecting a bridging unit 48B.

FIG. 9A shows that an additional ramp unit 49A and an additional bridging unit 48A have been previously erected and they have been used to set up construction equipment 65 and to deliver other construction means and materials to the work area. It can also be seen in FIG. 9A that the two rightmost northbound travel lanes of bridge roadway 23 are closed to existing traffic using construction traffic barriers during a period of off-peak traffic as specified by the transportation authority. Existing traffic is diverted onto the remaining northbound travel lanes and a bridging unit 48B is then erected using construction equipment 65 with minimal disruption of existing traffic.

Then, as can be seen in FIG. 9B, construction equipment 65 and other construction means have been stored on the previously erected bridging unit 48B, construction traffic barriers have been removed from the existing roadways, and the two rightmost northbound travel lanes are opened beneath bridging units 48A and 48B, and ramp unit 49A in time for the next period of peak traffic as specified by the transportation authority.

The step of erecting a bridging unit, as shown in FIGS. 9A and 9B, is repeated until all of a predetermined number of bridging units are erected.

Figure 9C:
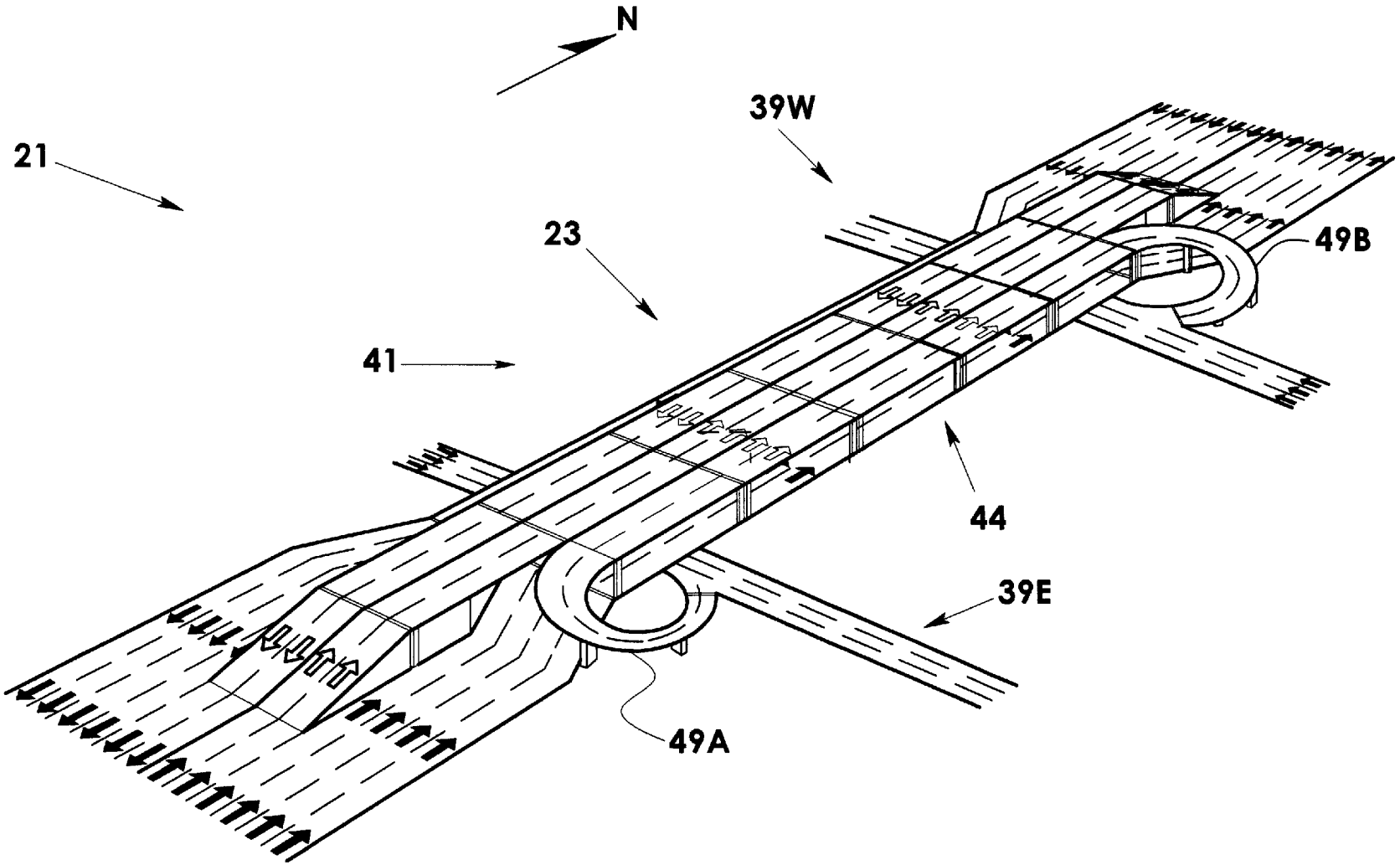
FIG. 9C shows a perspective view of the existing roadway, new elevated roadway, two local roadways, and of the additional new elevated roadway after its erection has been completed.

As shown in FIG. 9C, entrance/exit ramp units 49A and 49B and all bridging units of elevated roadway 44 have been erected and the entirely erected elevated roadway 44 is open to traffic from roadway 39E to roadway 39W as specified by the transportation authority.

Thus, by utilizing this additional embodiment, the new elevated roadway is erected with minimal disruption of existing traffic, because at each step, the existing roadway is open to existing traffic during periods of peak traffic, and the predetermined number of existing travel lanes is closed to existing traffic during periods of off-peak traffic.

In this example, it was shown that ramp unit 49A was erected at the beginning of erection of elevated roadway 44, and that ramp unit 49B was erected at the end of erecting elevated roadway 44. However, an option of erecting both ramp units at predetermined locations at the beginning of erecting elevated roadway 44 could have been utilized. It was also possible to utilize still another option of erecting both ramp units at the end of erecting elevated roadway 44. These options provide opportunity to schedule erecting of ramp units and bridging units in such a way that disruption of existing traffic will be minimal.

Conclusion, Ramifications, and Scope of Invention

Thus, the reader can see that reconstructing an existing roadway comprising erecting a new elevated roadway above the existing roadway and restoring the existing roadway can be performed with minimal disruption of existing traffic utilizing the present invention. Also, as a further benefit, the new elevated roadway adds permanent traffic capacity to the existing roadway and allows future maintenance to be performed with minimum disruption of traffic.

While the description above contains many specificities, these should not be construed as limitations on the scope of the invention but as merely providing illustrations of some of the presently preferred embodiments of this invention.

Many other variations are possible, for example:

The present invention is applicable to a great variety of different types of existing roadways carrying any number of existing travel lanes, and to elevated roadways carrying as many elevated travel lanes as required by transportation authorities.

Restoring structural integrity of an existing roadway may be performed in a single step by erecting a sufficient number of elevated travel lanes, so that all existing traffic may be rerouted from the existing roadway onto the elevated travel lanes at once.

Since the width of travel lanes is standard, a moveable ramp unit or the entire elevated roadway can be assembled and disassembled from standard sub-units of easily transportable size. These modular structures can be transported to and be utilized on many different reconstruction projects.

Erection of a new elevated roadway using the preferred embodiment may originate at any predetermined location of an existing roadway and may progress in two opposite directions simultaneously by utilizing two moveable ramp units. Thus, reconstruction time may be significantly shortened.

In order to minimize impact on traffic, a portion of the existing roadway, where the ramp units are initially erected, may be widened or the ramp units may be pre-assembled off-site and erected on-site during periods of off-peak traffic.

Depending on traffic requirements during erecting a new elevated roadway, a moveable ramp unit may provide a lesser number of travel lanes than are provided by bridging units, thus reducing power requirements for moving the moveable ramp unit. In its final location, the moveable ramp unit may be replaced with a fixed entrance/exit ramp unit, that provides at least as many travel lanes as provided by the bridging units. Or, the moveable ramp unit may be fixed at its final location and additional travel lanes may be provided by erecting additional ramp units.

Ramp units may be split in order to provide direct access for fast-moving traffic and emergency vehicles to the leftmost travel lanes of an existing roadway underneath a new elevated roadway. Or ramp units may be split in order to provide direct access from a predetermined elevated travel lane to a predetermined travel lane of an existing roadway.

A new elevated roadway may be designated for "passenger cars only", thus providing a separation of car traffic and truck traffic. Traffic separation means, such as appropriate traffic signs, attenuating barriers, and traffic gates with overhead clearance tracking devices, may be installed on existing roadway's approaches to the new elevated roadway. Such elevated roadways may be used for alternating direction of traffic during periods of peak traffic to coincide with commuter needs.

Bridging units may be erected utilizing different types of main frames of bridging units in order to accommodate various existing traffic patterns, vertical clearance limitations, special use travel lanes, or incorporation of a light rail line.

Accordingly, the scope of the invention should be determined by the appended claims and their legal equivalents, rather than by the examples given.

What is claimed is:

1. A method of reconstructing a predetermined section of an existing roadway with minimal disruption of existing traffic, said existing roadway, which is governed by a transportation authority, providing a plurality of existing travel lanes carrying said existing traffic along said existing roadway, said existing traffic having periods of peak traffic and periods of off-peak traffic, said method of reconstructing comprising the stages of:

(A) first erecting a new elevated roadway atop said existing roadway, said new elevated roadway of a predetermined length disposed substantially above said predetermined section of said existing roadway so that a longitudinal axis of said new elevated roadway is aligned mostly along said existing roadway, said new elevated roadway, providing a plurality of elevated travel lanes, comprises a predetermined number of bridging units and a predetermined number of ramp units, at least one of said ramp units shall be a moveable ramp unit equipped with means for propelling said moveable ramp unit along said existing roadway, each of said bridging units having a roadway deck oriented mostly parallel to said existing roadway, each of said ramp units having a mostly inclined roadway deck, said erecting comprising the steps of:

(a) erecting said predetermined number of said ramp units by:

(i) closing a predetermined portion of a predetermined number of said existing travel lanes to said existing traffic for a predetermined period of time after rerouting with minimal disruption said existing traffic onto the existing travel lanes that remain open to said existing traffic, (ii) erecting at least two of said ramp units, at least one of which shall be a moveable ramp unit, atop the closed portion of said existing travel lanes so that an uppermost end of said moveable ramp unit is adjacent to and faces an uppermost end of another of said ramp units, thereby creating a continuous portion of said new elevated roadway, which is prepared for passage of said existing traffic, and (b) repeatedly, until said predetermined number of said bridging units is erected, (i) closing a previously erected portion of said new elevated roadway to said existing traffic during a period of off-peak traffic after rerouting with minimal disruption said existing traffic onto the existing travel lanes that remain open to said existing traffic, (ii) breaking continuity of said previously erected portion of said new elevated roadway by moving said moveable ramp unit along said existing roadway thereby creating a gap between said movable ramp unit and a remainder of said previously erected portion of said new elevated roadway, (iii) bridging said gap between said movable ramp unit and said remainder of said previously erected portion of said new elevated roadway by erecting at least one of said bridging units in the gap, thereby creating an extended portion of said new elevated roadway, which is continuous and is prepared for passage of said existing traffic, (iv) opening said extended portion of said new elevated roadway, which is continuous and is prepared for passage of said existing traffic, to said existing traffic prior to the next period of said peak traffic while rerouting with minimal disruption said existing traffic onto said extended portion of said new elevated roadway during said period of peak traffic;

(B) then restoring a predetermined area of said existing roadway by repeatedly, until said restoring of said predetermined area is completed.

(a) closing a predetermined length of a predetermined number of said existing travel lanes to said existing traffic for a predetermined period of time after rerouting with minimal disruption said existing traffic onto the existing travel lanes that remain open to said existing traffic, (b) restoring said predetermined length of said predetermined number of said existing travel lanes closed to said existing traffic, and (c) opening the restored length of said existing travel lanes to said existing traffic, whereby the reconstructing of said existing roadway will be performed with minimal disruption of said existing traffic.

2. The method according to claim 1, further including the step of erecting traffic separation means above said existing roadway, whereby precluding truck traffic access to a predetermined number of the travel lanes designated as passenger cars only travel lanes.

3. The method according to claim 1, further including the step of replacing said moveable ramp unit with a fixed ramp unit at a predetermined location.

4. The method according to claim 1, further including the repeated steps of storing construction means underneath a previously erected portion of said new elevated roadway prior to the next period of peak traffic and of removing said construction means from underneath said previously erected portion of said new elevated roadway during periods of off-peak traffic.

5. The method according to claim 1, further including the step of performing erecting work underneath said moveable ramp unit during said periods of peak traffic.

6. The method according to claim 1, further including the step of widening a predetermined portion of said existing roadway by constructing a predetermined number of travel lanes, whereby disruption of said existing traffic during erecting said new elevated roadway will be further minimized.

7. A method of reconstructing a predetermined section of an existing roadway with minimal disruption of existing traffic, said existing roadway, which is governed by a transportation authority, providing a plurality of existing travel lanes carrying said existing traffic along said existing roadway, said existing traffic having periods of peak traffic and periods of off-peak traffic, said method comprising the stages of:

(A) first erecting a new elevated roadway atop said existing roadway, said new elevated roadway of a predetermined length disposed substantially above said predetermined section of said existing roadway so that a longitudinal axis of said new elevated roadway is aligned mostly along said existing roadway, said new elevated roadway, providing a plurality of elevated travel lanes, comprises a predetermined number of bridging units and a predetermined number of ramp units, at least one of said ramp units shall be a curved ramp unit, said curved ramp unit having curvature in a horizontal plane, each of said bridging units having a roadway deck oriented mostly parallel to said existing roadway, each of said ramp units having a mostly inclined roadway deck, said erecting comprising the steps of:

(a) repeatedly, until said predetermined number of said ramp units is erected:

(i) closing a predetermined portion of a predetermined number of said existing travel lanes to said existing traffic during a period of off-peak traffic after rerouting with minimal disruption said existing traffic onto the existing travel lanes that remain open to said existing traffic, (ii) erecting a predetermined portion of at least one of said ramp units above the closed portion of the existing travel lanes, (iii) opening the previously closed portion of the existing travel lanes beneath the previously erected portion of the ramp unit to said existing traffic prior to the next period of peak traffic and rerouting with minimal disruption said existing traffic onto the newly opened travel lanes, which are prepared for passage of said existing traffic, and (b) repeatedly, until said predetermined number of said bridging units is erected, (i) closing a predetermined portion of a predetermined number of said existing travel lanes to said existing traffic during a period of off-peak traffic after rerouting with minimal disruption said existing traffic onto the existing travel lanes that remain open to said existing traffic, (ii) erecting at least one of said bridging units at a predetermined location atop the previously closed portion of said existing travel lanes, (iii) opening the previously closed portion of the existing travel lanes beneath the previously erected bridging units to said existing traffic prior to the next period of peak traffic and rerouting with minimal disruption said existing traffic onto the newly opened travel lanes, which are prepared for passage of said existing traffic, (B) then restoring a predetermined area of said existing roadway by repeatedly, until said restoring of said predetermined area is completed, (a) closing a predetermined length of a predetermined number of said existing travel lanes to said existing traffic for a predetermined period of time after rerouting with minimal disruption said existing traffic onto the existing travel lanes that remain open to said existing traffic, (b) restoring said predetermined length of said predetermined number of said existing travel lanes closed to said existing traffic, and (c) opening the restored length of said existing travel lanes to said existing traffic, whereby the reconstructing of said existing roadway will be performed with minimal disruption of said existing traffic.

8. The method according to claim 7, further including the step of erecting traffic separation means above said existing roadway, whereby precluding truck traffic access to a predetermined number of the travel lanes designated as passenger cars only travel lanes.

9. The method according to claim 7, further including the repeated steps of storing construction means atop a previously erected portion of said new elevated roadway prior to the next period of peak traffic and of removing said construction means from said previously erected portion of said new elevated roadway during periods of off-peak traffic.

10. The method according to claim 7, further including the step of performing erecting work atop a previously erected portion of said new elevated roadway during said periods of peak traffic.

11. The method according to claim 7, further including the step of widening a predetermined portion of said existing roadway by constructing a predetermined number of travel lanes, whereby disruption of said existing traffic during erecting said new elevated roadway will be further minimized.

* * * * *